US008945453B2

(12) United States Patent
Kitagawa et al.

(10) Patent No.: US 8,945,453 B2
(45) Date of Patent: Feb. 3, 2015

(54) METHOD FOR PRODUCING POLYTETRAFLUOROETHYLENE FIBER AND POLYTETRAFLUOROETHYLENE FIBER

(75) Inventors: Daisuke Kitagawa, Osaka (JP); Takashi Wano, Osaka (JP); Hideki Yamane, Kyoto (JP); Yoshihito Takagi, Kyoto (JP)

(73) Assignees: Nitto Denko Corporation, Hyogo (JP); National University Corporation Kyoto Institute of Technology, Kyoto (JP)

( * ) Notice: Subject to any disclaimer, the term of this patent is extended or adjusted under 35 U.S.C. 154(b) by 1447 days.

(21) Appl. No.: 12/665,231

(22) PCT Filed: Jun. 16, 2008

(86) PCT No.: PCT/JP2008/060994
§ 371 (c)(1),
(2), (4) Date: Apr. 16, 2010

(87) PCT Pub. No.: WO2008/156059
PCT Pub. Date: Dec. 24, 2008

(65) Prior Publication Data

US 2010/0203332 A1 Aug. 12, 2010

(30) Foreign Application Priority Data

Jun. 18, 2007 (JP) ..... 2007-160618
Oct. 19, 2007 (JP) ..... 2007-273210
Feb. 14, 2008 (JP) ..... 2008-032770

(51) Int. Cl.
*D01F 6/12* (2006.01)
*D01D 5/12* (2006.01)

(52) U.S. Cl.
CPC ... *D01F 6/12* (2013.01); *D01D 5/12* (2013.01)
USPC ..... 264/289.6; 264/290.5

(58) Field of Classification Search
CPC ..... D01D 10/00; B29C 55/30
USPC ..... 264/290.5, 289.6
See application file for complete search history.

(56) References Cited

U.S. PATENT DOCUMENTS 4,643,865 A * 2/1987 Okada et al. ..... 264/288.4
5,686,033 A 11/1997 Shimizu (Continued)

FOREIGN PATENT DOCUMENTS

EP 1 439 247 7/2004
JP 03051338 A * 3/1991

(Continued)

OTHER PUBLICATIONS

Fukuhara et al., JP 10273818 A, Oct. 1998 Derwent Abstract.*

(Continued)

*Primary Examiner* — Galen Hauth
(74) *Attorney, Agent, or Firm* — Hamre, Schumann, Mueller & Larson, P.C.

(57) ABSTRACT

The present invention provides a method for producing a PTFE fiber that makes it possible, unlike the emulsion spinning process, to obtain a polytetrafluoroethylene (PTFE) fiber, particularly a long PTFE fiber, without using a matrix material, is more productive than conventional production methods such as a slit yarn process, and is capable of enhancing mechanical properties and the degree of freedom in diameter of the obtained fiber. The method for producing the PTFE fiber of the present invention includes the step of reducing a diameter of a string-shape PTFE-containing solid material (a first solid material) by drawing the first solid material at a temperature equal to or higher than a melting point of PTFE. The first solid material can be obtained from a PTFE-containing solid material (a second solid material) containing water and a surfactant, by reducing an amount of the water contained in the second solid material.

8 Claims, 41 Drawing Sheets

(56) References Cited

U.S. PATENT DOCUMENTS

| | | | | |
|---|---|---|---|---|
| 5,820,984 | A * | 10/1998 | Blankenbeckler et al. | 428/393 |
| 6,133,165 | A | 10/2000 | Tamaru et al. | |
| 7,108,912 | B2 | 9/2006 | Huang et al. | |
| 2005/0222313 | A1 * | 10/2005 | Tomihashi et al. | 524/366 |
| 2009/0121377 | A1 * | 5/2009 | Wano et al. | 264/117 |

FOREIGN PATENT DOCUMENTS

| | | | |
|---|---|---|---|
| JP | 8-199421 | A | 8/1996 |
| JP | 10-273818 | A | 10/1998 |
| JP | 10273818 | A * | 10/1998 |
| JP | 2003-020515 | A | 1/2003 |
| JP | 2005-248377 | A | 9/2005 |
| JP | 2007-100230 | | 4/2007 |
| WO | WO 2006/120967 | A1 | 11/2006 |
| WO | WO 2006120967 | A1 * | 11/2006 |

OTHER PUBLICATIONS

Yamamoto et al., JP 03051338 A, Mar. 1991 Derwent Abstract.*

* cited by examiner

Drawing
temperature
２５０℃

Drawing
temperature
３２０℃

Drawing
temperature
３３０℃

Drawing temperature 340℃

Drawing
temperature
３５０℃

Drawing
temperature
360℃

Drawing temperature 370℃

Drawing
temperature
３８０℃

PTFE fiber
(Toyoflon)
produced by
matrix process

PTFE fiber
produced by slit
yarn process

Drawing temperature 330°C
Drawing rate 0.8m/min

Drawing temperature 330°C
Drawing rate 2.8m/min

Drawing temperature 350°C
Drawing rate 0.8m/min

Drawing temperature 350°C
Drawing rate 2.8m/min

Drawing temperature 380℃
Drawing rate 0.8m/min

Drawing temperature380℃
Drawing rate 4.2m/min

Drawing temperature 400℃
Drawing rate 0.8m/min

Drawing temperature 400℃
Drawing rate 8.4m/min

Drawing temperature 330℃
Drawing rate 0.8m/min

Drawing temperature 330℃
Drawing rate 2.8m/min

Drawing temperature 350℃
Drawing rate 0.8m/min

Drawing temperature 350℃
Drawing rate 2.8m/min

Drawing temperature 380°C
Drawing rate 0.8m/min

Drawing temperature 380°C
Drawing rate 4.2m/min

Drawing temperature 400°C
Drawing rate 0.8m/min

Drawing temperature 400°C
Drawing rate 8.4m/min

Drawing temperature 330℃
Drawing rate 0.8m/min

Drawing temperature 330℃
Drawing rate 2.8m/min

Drawing temperature 350℃
Drawing rate 0.8m/min

Drawing temperature 350℃
Drawing rate 2.8m/min

Drawing temperature 380°C
Drawing rate 0.8m/min

Drawing temperature 380°C
Drawing rate 4.2m/min

Drawing temperature 400°C
Drawing rate 0.8m/min

Drawing temperature 400°C
Drawing rate 8.4m/min

METHOD FOR PRODUCING POLYTETRAFLUOROETHYLENE FIBER AND POLYTETRAFLUOROETHYLENE FIBER

TECHNICAL FIELD

The present invention relates to a method for producing a polytetrafluoroethylene (PTFE) fiber and a PTFE fiber.

BACKGROUND ART

PTFE has various excellent properties, such as heat resistance, light resistance, chemical resistance, electrical insulation, and tribological property, and is used in various fields mainly of mechanical, chemical, and electrical fields. PTFE fibers are one of articles (PTFE articles) containing PTFE and expected to be applied to various fields based on the various kinds of properties that PTFE has.

As the method for producing fibers, a melt spinning process and a wet spinning process are common. However, since PTFE has an extremely high melt viscosity of approximately $10^{10}$ to $10^{11}$ Pa·($10^{11}$ P to $10^{12}$ P) at 380° C., the melt spinning process cannot be used to produce the PTFE fibers. Moreover, since PTFE does not dissolve in most solvents except for specific solvents, it also is difficult to use the simple wet spinning process in which a PTFE solution obtained by dissolving PTFE in an appropriate solvent is extruded into a bath of a poor solvent and solidified.

Conventionally, an emulsion spinning process and a slit yarn process are known as the method for producing the PTFE fibers.

In the emulsion spinning process, there are a direct emulsion spinning process and a matrix spinning process. The matrix spinning process (as disclosed in JP 10 (1998)-273818 A, for example) mainly is used because it is more productive than the direct spinning process that requires extruding an aqueous emulsion of PTFE into a hydrochloric acid bath or a hydrogen chloride atmosphere. In the matrix spinning process, a material solution for spinning is prepared by adding a matrix material, such as viscose and cellulose, to a dispersion of PTFE particles, and then the material solution is extruded into a coagulation bath to be wet-spun. Thereafter, the fiber formed by the spinning is heat-treated (sintered) at a temperature equal to or higher than a melting point of PTFE so that the matrix material in the fiber is fired and removed as well as the PTFE particles dispersed in the matrix material being melted and fused to each other. Thus, the PTFE fiber can be formed. Usually, however, decomposing materials (carbides) of the matrix material remain in the PTFE fiber produced by this method, which may affect the physical and chemical properties that PTFE has intrinsically. For example, the PTFE fiber formed by the matrix spinning process has a color tone of brown to dark brown, which limits applications of the fiber. Moreover, since the matrix material and the decomposing materials thereof basically are unnecessary components for the PTFE fiber, a method for producing the PTFE fiber that requires no matrix material is desired.

The slit yarn process (as disclosed in U.S. Pat. No. 6,133,165 and U.S. Pat. No. 7,108,912, for example) can form the PTFE fiber by the following processes. (1) extrusion-molding a PTFE paste obtained by adding a forming aid to a PTFE fine powder into a sheet-like product, (2) removing the forming aid from the product, and then stretching the product to make a porous PTFE membrane, (3) processing mechanically the obtained porous membrane into a strip shape or a tape shape, and (4) stretching further the processed porous membrane.

The reason why the paste is once extrusion-molded into a sheet shape or a film shape is because it is difficult to mold the paste directly into a fiber shape due to its high viscosity. With the slit yarn process, however, it is difficult to produce a fiber that is uniform in diameter and a long fiber (filament), although this depends on the way of the mechanical processing. It also is difficult to produce continuously a fiber from the raw material fine powder. Thus, the slit yarn process cannot be regarded as a highly productive production method.

As another method for producing the PTFE fiber, JP 2003-20515 A, for example, discloses a method in which an aqueous suspension of PTFE fine particles is pressurized to around 5 to 10 kgf/cm$^2$ and sprayed from a capillary-shape die with an inner diameter of 200 μm to 400 μm so as to form the PTFE fine particles into a fiber, and then the fiber is dried and sintered. However, this method is unlikely to allow the production of the PTFE fiber that has excellent mechanical properties, such as strength and elastic modulus. Moreover, since the diameter of the capillary from which the suspension is sprayed probably is limited to the range of 200 μm to 400 μm for ensuring the pressure to be applied to the suspension, the degree of freedom in diameter is so low that the diameter of the producible PTFE fiber is 20 μm or less.

WO 2006/120967 discloses a method for obtaining an aggregate of PTFE particles containing water and a surfactant by applying a force that makes the particles approach or contact with each other to a dispersion of PTFE particles. WO 2006/120967 describes that by drying and/or sintering this aggregate, a string-shape PTFE product can be obtained, for example.

As described above, the conventional methods for producing the PTFE fiber require a component, such as the matrix material, that basically is unnecessary for the PTFE fiber, limit the producible fibers to short (staple) fibers, and limit the enhancement in productivity. Also, the PTFE fibers obtained by the conventional methods have poor mechanical properties and a low degree of freedom in diameter.

DISCLOSURE OF THE INVENTION

An object of the present invention is to provide a method for producing a PTFE fiber that makes it possible to produce, unlike the above-mentioned conventional production methods, a PTFE fiber, particularly a long PTFE fiber, without using a matrix material, that is more productive than the conventional production methods, and that can enhance the mechanical properties and the degree of freedom in diameter of the obtained fiber.

Another object of the present invention is to provide a new PTFE fiber with a completely different structure from those of the above-mentioned conventional PTFE fibers.

The method for producing the PTFE fiber of the present invention is a method for producing a PTFE fiber, includes a step of reducing a diameter of a string-shape PTFE-containing solid material (a first solid material) by drawing the first solid material at a temperature equal to or higher than a melting point of PTFE.

The PTFE fiber of the present invention is a fiber obtained by drawing a string-shape PTFE-containing solid material at a temperature equal to or higher than the melting point of PTFE so as to reduce a diameter of the solid material.

The present invention makes it possible to obtain the PTFE fiber without using the matrix material required in the emulsion spinning process. For example, the present invention makes it possible to produce the PTFE fiber having the intrinsic properties and color tone of PTFE. As for the color tone, it is possible to produce the PTFE fiber with white color, for example, and in some cases it also is possible to produce a more transparent PTFE fiber as in the Example to be described below.

The present invention makes it possible to produce the PTFE fiber without performing the step of extrusion-molding the raw material PTFE particles and the step of processing mechanically the sheet-like product obtained by the extrusion-molding, which are required in the slit yarn process. Thereby, the PTFE fiber can be produced with a higher productivity than before, and not only the short PTFE fiber but also the long PTFE fiber can be produced. Moreover, by selecting the shape of a member to be used for the drawing, it is possible to produce the PTFE fiber with an approximately circular or approximately oval cross-sectional shape, for example, and to enhance the degree of freedom in shape of the obtained PTFE fiber. The present invention can enhance the mechanical properties and the degree of freedom in diameter of the obtained PTFE fiber more greatly than the method disclosed in JP 2003-20515 A.

BEST MODE FOR CARRYING OUT THE INVENTION

Figure 1:
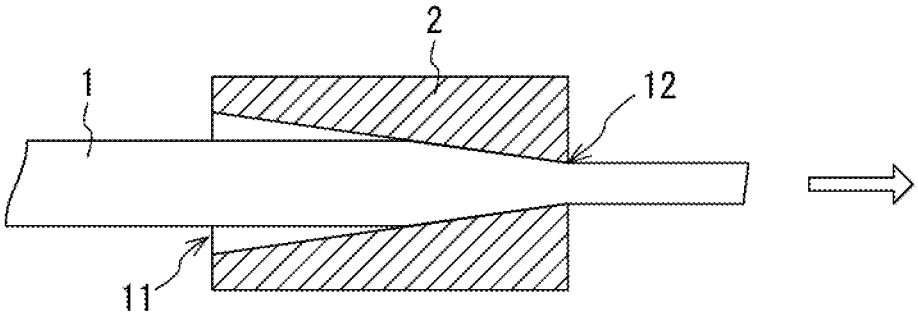
FIG. 1 is a schematic view for illustrating an example of the method for producing the PTFE fiber of the present invention.

An example of the production method of the present invention will be described using FIG. 1. In the method shown in FIG. 1, a diameter of a string-shape PTFE-containing solid material (a first solid material) 1 is reduced by drawing at a temperature equal to or higher than a melting point of PTFE (hereinafter simply referred to as a "melting point") (approximately 327° C. or higher) through a die (a first die) 2.

This method makes it possible to produce not only a PTFE staple but also a PTFE filament. Moreover, the method makes it possible to produce a white fiber because it uses no matrix material, and also makes it possible to produce a more transparent (translucent) PTFE fiber in some cases. Furthermore, this method can enhance the mechanical properties of the solid material 1 by a drawing process at a temperature equal to or higher than the melting point. That is, the method makes it possible to produce the PTFE fiber with enhanced mechanical properties.

The reason why such a fiber can be produced by the production method of the present invention is not well defined yet because the structure of the obtained fiber is still under study. One explanation is that the drawing at a temperature equal to or higher than the melting point melts PTFE contained in the solid material 1 and applies a force that reduces the diameter of the solid material so as to form a fused portion of PTFE extended in an axial direction of the fiber. For example, when the solid material 1 is formed from a dispersion of PTFE particles by the below-mentioned method 1 or 2, the solid material contains the PTFE particles in a central portion thereof depending on the condition of the formation. The drawing of such a solid material containing the PTFE particles allows the PTFE particles to be fused to each other and reduces the diameter of the solid material so as to form a fused portion of the PTFE particles extended in the axial direction of the fiber.

The fused portion is not formed by conventional methods for producing the PTFE fiber. In the slit yarn process, for example, an extruded PTFE sheet is stretched and processed mechanically, and further stretched once again to make fibers. Thus, the obtained fiber includes countless fine fibrils, and fine gaps are present among the fibrils. In contrast, the fused portion typically has a larger diameter than those of the fibrils as will be described in the below-mentioned Example. Moreover, in the PTFE fiber of the present invention, the gaps present among the fibers are larger in size and significantly smaller in number than in the fibers formed by the slit yarn process. For these reasons, the production method of the present invention makes it possible to obtain the PTFE fiber with excellent mechanical properties, and furthermore, makes it possible to produce the translucent PTFE fiber because irregular reflection of light caused by the gaps is reduced.

In the production method of the present invention, the degree of reducing the diameter of the solid material 1 and the shape achieved by the diameter reduction of the solid material 1 can be controlled by selecting the shape of a member, such as the first die 2, used for reducing the diameter of the solid material 1. Thus, it is possible to increase the degree of freedom in diameter and cross-sectional shape of the obtained fiber.

In the production method of the present invention, it also is possible to produce continuously the PTFE fiber from the dispersion of PTFE particles that is a starting material of the method when the solid material 1 to be drawn is obtained by the below-mentioned method. As a result, the production method of the present invention can be a more productive method for producing the PTFE fiber than conventional methods.

The temperature at which the drawing is performed (a drawing temperature) is not particularly limited as long as it is equal to or higher than the melting point of PTFE. For example, the drawing temperature preferably is 330° C. or higher, more preferably 340° C. or higher, still more preferably 350° C. or higher, still more preferably 360° C. or higher, and still more preferably 380° C. or higher. Accordingly, the PTFE fiber with more excellent mechanical properties can be produced.

The upper limit for the drawing temperature is not particularly limited as long as it is lower than a decomposition temperature of PTFE. For example, the upper limit may be 490° C. or lower.

The drawing temperature may be equal, for example, to the temperature of a member, such as the first die 2, used for reducing the diameter of the first solid material, and/or to the temperature of the first solid material. The drawing temperature can be controlled by adjusting the temperature of an atmosphere of processing and/or the temperature of the above-mentioned member, for example.

When the first solid material is formed by the methods (methods 1 and 2) to be described later, the first solid material contains a surfactant. At this time, by setting the drawing temperature to be higher than a decomposition temperature of the surfactant contained in the first solid material, it also is possible to reduce the amount of the surfactant contained in the first solid material while reducing the diameter of the first solid material.

The method for drawing the first solid material at a temperature higher than the melting point of PTFE is not particularly limited. For example, the drawing may be performed by drawing the first solid material through a gap, such as a slit or an orifice, that has a smaller diameter than the diameter of the solid material, without using the die as shown in FIG. 1. However, as shown in FIG. 1, the method in which the first solid material is drawn through a die is preferable from the viewpoint of realizing a stable production of the PTFE fiber.

The first die 2 shown in FIG. 1 has such a shape that applies a shearing stress to the solid material 1 and decreases the diameter of the string-shape solid material 1 at the time of drawing. Specifically, the die 2 includes a portion as an inside space (a space through which the solid material 1 passes), a cross section of the portion is circular and decreases in area continuously from an inlet 11 of the solid material 1 toward a discharge port 12 of the solid material 1, and the cross section is perpendicular to a direction in which the solid material 1 is drawn. More specifically, the inside space of the die 2 has a circular truncated cone shape with a bottom face located on the inlet 1 side. The discharge port 12 is provided in an upper face of the circular truncated cone.

The shape of the first the 2 is not particularly limited as long as it allows the solid material to be drawn therethrough. Preferably, the 2 includes a portion as an inside space (a space through which the first solid material passes), the cross section of the portion decreases in area continuously from one opening (the inlet 11) toward another opening (the discharge port 12) of the first die, and the cross section is perpendicular to the direction in which the first solid material is drawn. In this case, the diameter of the solid material 1 can be reduced smoothly. Particularly, it is preferable that the has the above-mentioned portion as its entire inside space, as the die 2 shown in FIG. 1.

The first die 2 includes the space through which the solid material 1 passes, and the cross section of the space, which is perpendicular to the direction in which the solid material 1 is drawn, has preferably a circular or oval shape, and more preferably a circular shape. In this case, it is possible to reduce the diameter of the solid material 1 smoothly and to produce the PTFE fiber with an approximately circular or approximately oval cross-sectional shape.

When the first die 2 has the portion in which the above-mentioned cross section is circular and the area of the cross section decreases continuously and constantly, the portion of the 2 is in the shape of a circular truncated cone. In this case, an angle (so-called "die angle $\alpha$") between a generatrix and a central axis of the circular truncated cone is not particularly limited.

The degree of diameter reduction of the first solid material by the drawing is not particularly limited. For example, the diameter of the solid material 1 may be reduced to 1 mm or less, or may be reduced to 750 μm or less, 500 μm or less, and 400 μm or less, and further to 200 μm or less. In order to increase the degree of diameter reduction, a diameter of the discharge port 12 of the first the 2 may be reduced. Raising the drawing temperature also can increase the degree of diameter reduction of the first solid material.

In the production method of the present invention, the diameter of the first solid material may be reduced stepwise by drawing the first solid material twice or more at a temperature equal to or higher than the melting point. When an attempt is made to form the first solid material into a fiber with a desired diameter only by a single drawing, the degree of diameter reduction of the solid material excessively is increased at the time of drawing, and sometimes it is difficult to draw the first solid material stably. When the drawing is performed two times or more, the degree of diameter reduction of the first solid material can be adjusted at each of the drawings and the drawing of the first solid material can be performed more stably.

In order to perform the drawing two times or more, the first solid material is made to pass through two or more of the first dies. The degree of diameter reduction at each die, the drawing temperature at each die, the number of the first dies through which the first solid material passes, etc. are adjusted suitably according to the deformability of the first solid material, the diameter of the first solid material before passing through the die, a diameter of a desired fiber, etc.

When the first solid material is drawn through two or more of the first dies, a mechanism for delivering the solid material, constituted by a roller, etc., may be provided between the first dies so that the mechanism delivers the first solid material to the next the while the first solid material is being drawn through the previous die. In this case, the PTFE fiber can be produced more stably.

In the production method of the present invention, the first solid material continuously may be drawn at a temperature equal to or higher than the melting point (in the example shown in FIG. 1, for example, the solid material 1 continuously may be made to pass through the first die 2 at a temperature equal to or higher than the melting point). In this case, a PTFE filament can be produced. Also, a PTFE staple can be produced. For example, the PTFE staple effectively can be produced by cutting the filament formed as mentioned above with a cutter or the like. This method makes it possible to produce effectively the staples with a uniform diameter.

In the production method of the present invention, after the first solid material is drawn at a temperature equal to or higher than the melting point, the drawn solid material (fiber) may be cooled by an arbitrary method such as natural cooling. For example, it is possible to change the crystal structure, such as the degree of crystallization, of the solid material (fiber) by cooling the solid material (fiber) slowly.

The structure of the first solid material is not particularly limited as long as it contains PTFE. For example, the first solid material may be a solid material obtained from a PTFE-containing solid material (a second solid material) containing water and a surfactant, by reducing an amount of the water contained in the second solid material. The second solid material containing water and a surfactant can be formed by the method 1 or the method 2 to be described later, for example.

Or the first solid material may be a solid material obtained by drawing the PTFE-containing solid material (the second solid material) containing water and a surfactant through a die (a second die) so as to reduce a diameter of the second solid material, and then reducing the amount of the water contained in the second solid material.

The first solid material may be a strip-shape or tape-shape PTFE membrane formed by the slit yarn method. When drawing the strip-shape or tape-shape PTFE membrane, there seems to be a practical limitation in the width thereof (that is, the width cannot be excessively large with respect to its thickness). Thus, the strip-shape or tape-shape PTFE membrane that can be drawn is regarded as "the string-shape PTFE-containing solid material" described in the production method of the present invention.

Figure 2:
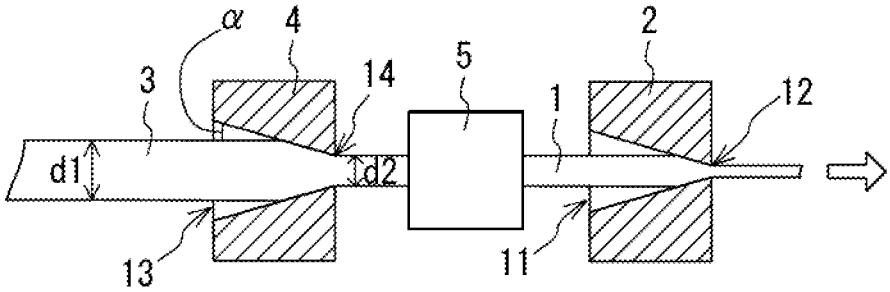
FIG. 2 is a schematic view for illustrating another example of the method for producing of the PTFE fiber of the present invention.

FIG. 2 shows an example of the production method of the present invention using, as the first solid material 1, a solid material obtained by drawing a second solid material 3 containing water and a surfactant through a second die 4, and then reducing the amount of the water contained in the second solid material.

In the method shown in FIG. 2, the string-shape PTFE-containing solid material (the second solid material) 3 containing water and a surfactant is drawn first through the (the second die) 4 so as to reduce a diameter of the solid material 3.

The die 4 shown in FIG. 2 has a shape that applies a shearing stress to the solid material 3 and decreases the diameter of the string-shape solid material 3 at the time of drawing. Specifically, the die 4 includes a portion as an inside space (a space through which the solid material 3 passes), a cross section of the portion is circular and decreases in area continuously from an inlet 13 of the solid material 3 toward a discharge port 14 of the solid material 3, and the cross section is perpendicular to a direction in which the solid material 3 is drawn. More specifically, the inside space of the die 4 has a circular truncated cone shape with a bottom face located on the inlet 13 side. The discharge port 14 is provided in an upper face of the circular truncated cone.

Unlike the above-mentioned drawing performed at a temperature equal to or higher than the melting point, the drawing of this case is performed in a lower temperature range, for example, at 100° C. or lower. The reason why the solid material 3 can be drawn at such a temperature range is because the water and the surfactant contained in the solid material 3 allow the solid material 3 to have deformability.

When the solid material 3 is formed by the methods 1 and 2 described later, the solid material 3 has a structure in which PTFE particles are bound to each other, and this structure allows the solid material 3 to have a high self-forming maintainability. The structure in which the PTFE particles are bound to each other does not need to be formed in the entire solid material 3, and it may be formed only in a part of the solid material 3. In some cases, the structure is formed in a portion (a skin layer) in the vicinity of an outer circumferential surface of the string-shape solid material 3, and the PTFE particles and water are contained in a central portion of the solid material 3.

The solid material 3 may be drawn through the second die 4 in water.

As described above, the solid material 3 has deformability derived from water and a surfactant contained in the solid material 3, and the deformability is enhanced in water. Thus, by drawing the solid material 3 in water, it is possible to increase the degree of diameter reduction of the solid material 3 and the drawing rate for the solid material 3 when the solid material 3 is drawn through the die 4. That is, the productivity of the PTFE fiber can be enhanced.

When the drawing is performed in water, the solid material 3 may be made to pass through the die 4 in warm water at 50° C. or higher. That is, the solid material 3 may be drawn in warm water at a temperature of at 50° C. or higher. In this case, the deformability of the solid material 3 can be more enhanced, increasing further the productivity of the PTFE fiber. Preferably, the temperature of the warm water is 70° C. or higher. The upper limit for the temperature of the warm water is not particularly limited. Usually, it is 100° C., which is the boiling point of water, when the drawing is performed under atmospheric pressure.

When the solid material 3 is not drawn in water, for example, when the solid material 3 is drawn in air, the drawing may be performed with the temperature of the solid material 3 and/or the temperature of the die 4 being 50° C. or higher as in the case where the solid material 3 is drawn in water. This can enhance the deformability of the solid material 3 and the productivity of the PTFE fiber. It should be noted, however, that in this case, the amount of the water contained in the solid material 3 is reduced more easily, that is, the deformability of the solid material 3 is lowered more easily, than in the case where the drawing is performed in water.

The shape of the second die 4 is not particularly limited as long as it can reduce the diameter of the solid material 3. Preferably, the die 4 includes the portion as the inside space (the space through which the solid material 3 passes), the cross section of the portion is circular and decreases in area continuously from one opening (the inlet 13) toward another opening (the discharge port 14) of the die 4, and the cross section is perpendicular to the direction in which the solid material 3 is drawn. In this case, the diameter of the solid material 3 can be reduced more smoothly. Particularly, it is preferable that the die has the above-mentioned portion as its entire inside space, as the die 4 shown in FIG. 2.

Preferably, the above-mentioned cross section has a circular or oval shape, and more preferably a circular shape. In this case, the diameter of the solid material 3 can be reduced more smoothly. When the cross section has a circular shape and the area of the cross section decreases continuously and constantly, the above-mentioned portion of the second die 4 is in the shape of a circular truncated cone.

The degree of diameter reduction of the solid material 3 at the die 4, that is, an area reduction rate of the solid material 3 between before and after passing through the die 4, which is represented by $(\{1-(d2/d1)^2\}\times 100(\%))$, is not particularly limited. For example, the area reduction rate is 70% or less, and preferably about 10% to 50%, although it depends on the deformability of the solid material 3, diameter d1 of the solid material 3 before passing through the die 4, a diameter of a desired fiber, etc. An excessively large reduction rate may make it difficult to reduce the diameter of the solid material 3. The reduction rate can be controlled by adjusting a diameter of the inlet 13 and a diameter of the discharge port 14 of the die 4, for example.

As described above, the portion is in the shape of a circular truncated cone when the die 4 includes the portion as the inside space (the space through which the solid material 3 passes), the cross section of the portion is circular and decreases in area continuously from one opening toward another opening of the die 4, and the cross section is perpendicular to the direction in which the solid material 3 is drawn. An angle (so-called "die angle $\alpha$") between a generatrix and a central axis of the circular truncated cone is not particularly limited. Usually, it is about 2° to 20°. In order to keep a balance between the amount of the shearing stress applied to the solid material 3 and the degree of diameter reduction of the solid material 3, the angle preferably is 1° to 10°. A die angle in this preferable range can reduce the drawing resistance of the solid material 3 more easily.

The drawing of the second solid material through the second die may be performed stepwise by using two or more of the second dies.

When an attempt is made to reduce the diameter of the second solid material to a desired diameter by using only one die, the degree of diameter reduction of the second solid material excessively is increased at the time of drawing, and it may be difficult to draw the second solid material stably. When the second solid material is drawn through two or more of the second dies, the degree of diameter reduction of the second solid material can be adjusted at each of the drawings and the drawing of the second solid material can be performed more stably.

When the second solid material is drawn through two or more of the second dies, the degree of diameter reduction at each die, the number of the dies through which the second solid material passes, etc. are adjusted suitably according to the deformability of the second solid material, the diameter of the second solid material before passing through the die, a diameter of a desired fiber, etc.

When the second solid material is drawn through two or more of the second dies, a mechanism for delivering the solid material, constituted by a roller, etc., may be provided between the second dies so that the mechanism can deliver the second solid material to the next die while the second solid material is being drawn through the previous die. In this case, the PTFE fiber can be produced more stably.

In the method shown in FIG. 2, a drying mechanism 5 reduces subsequently the amount of the water contained in the solid material 3 that has been drawn through the die 4.

The method for reducing the amount of the water contained in the solid material 3 is not particularly limited. For example, the amount of the water contained in the diameter-reduced solid material 3 may be reduced by a heating apparatus such as a heater, or a drying mechanism with an air blower, etc. for air-drying the solid material 3. Or the amount of the water contained in the diameter-reduced solid material 3 may be reduced by natural drying, for example. When the heating apparatus, such as a heater, is used, the amount of the surfactant contained in the solid material 3 also can be reduced by raising the temperature at which the apparatus heats the solid material 3 to the decomposition temperature of the surfactant. Alternatively, the amount of the surfactant contained in the solid material 3 may be reduced by immersing the diameter-reduced solid material 3 in a solvent that dissolves the surfactant and dispersing the surfactant in the solvent.

The above-mentioned methods for reducing the amount of the water contained in the solid material 3 also can be applied in the case of reducing the amount of the water contained in the second solid material without drawing the second solid material through the second die.

In the method shown in FIG. 2, the solid material 3 from which the amount of the contained water has been reduced, which is the first solid material 1, subsequently is drawn through the first the 2 at a temperature equal to or higher than the melting point of PTFE so as to obtain the PTFE fiber.

In other words, in the method shown in FIG. 2, the PTFE fiber is formed by drawing the second solid material 3 containing water and a surfactant through the second die 4 so as to reduce the diameter of the second solid material 3, reducing the amount of the water contained in the diameter-reduced second solid material 3, and further drawing the second solid material 3 at a temperature equal to or higher than the melting point of PTFE.

The drawing of the solid material 3 through the second die 4 and the drawing of the solid material 1 through the first die 2 may be performed independently or successively. When these drawings are performed successively, the PTFE filament can be produced effectively.

The PTFE-containing solid material (the second solid material) containing water and a surfactant can be formed, for example, by applying a force that makes the PTFE particles approach or contact with each other to a dispersion of PTFE particles containing the PTFE particles, a surfactant, and water serving as a dispersion medium (method 1). The method 1 is a method disclosed in WO 2006/120967.

When the surfactant contained in the second solid material is a nonionic surfactant, the second solid material can be formed, for example, by applying a mechanical force to a dispersion of PTFE particles containing the PTFE particles, the nonionic surfactant, and water serving as a dispersion medium so as to allow the particles to collide with each other, and raising a temperature of the dispersion by a heat generated by the collision as well as allowing the particles to be bound to each other in a temperature range equal to or higher than (T−30)° C. in terms of the temperature of the dispersion, where T (° C.) denotes a clouding point of the nonionic surfactant (method 2).

As is apparent from the above-mentioned forming methods, the second solid material can be referred to as an aggregate formed by allowing the PTFE particles to be bound to each other.

The second solid materials formed by the methods 1 and 2 have self-forming maintainability and deformability, and basically can be deformed into arbitrary shapes until the time they are dried or sintered. One of the advantages of these solid materials is that there is a wide range in which they can be deformed without being broken.

The second solid materials formed by the methods 1 and 2 are obtained by allowing the PTFE particles to bind to each other to such an extent that the PTFE particles are not dispersed in water, and are not diluted with water. Thus, the second solid materials can be drawn through the second die in water.

The second solid materials formed by the methods 1 and 2 are obtained by allowing the PTFE particles to bound to each other to such an extent that the second solid materials do not return to particles in response to a reduction in the amount of the water contained in the second solid materials. The second solid materials thus formed do not return to particles even when they are dried, for example. Thus, the second solid materials can be drawn through the first die after the amount of the water contained therein is reduced.

The reason why such a solid material can be obtained by the methods 1 and 2 is not clear, but one possible explanation is that an effect of the surfactant contained in the dispersion forms a structure in which a PTFE phase obtained by allowing the PTFE particles to be bound to each other is present together with a water phase.

Particularly, in the method 2, there seems to be a mechanism in which the application of the mechanical force to the dispersion allows the PTFE particles to collide with each other and the temperature of the dispersion falls within the specific range so that the properties of the surfactant contained in the dispersion are changed and the PTFE phase is formed continuously to some extent. Also, the fact that, unlike other fluorinated thermoplastic resins, PTFEs can be bound to each other also in a temperature range equal to or lower than the melting point seems to contribute to forming the PTFE phase.

The dispersion of PTFE particles, which is a starting material of the method 2, contains a nonionic surfactant. Usually, the nonionic surfactant has clouding point T (° C.). The properties of the nonionic surfactant change significantly at the clouding point. For example, its function as the surfactant is lost in a temperature range equal to or higher than the clouding point. Moreover, the properties of the aqueous solution containing the nonionic surfactant also change significantly at the clouding point. For example, one of the changes is that the aqueous solution is separated into the PTFE phase and the water phase at the clouding point.

In the method 2, the PTFE particles are bound to each other in a temperature range equal to or higher than (T−30)° C. in terms of the temperature of the dispersion. The PTFE particles may be bound to each other at a temperature range equal to or higher than (T−10)° C., at a temperature range equal to or higher than (T−5)° C., or a temperature range equal to or higher than (T−3)° C. in terms of the temperature of the dispersion. In this order, the mechanical properties (such as tensile strength) of the obtained second solid material can be enhanced more, and the mechanical properties of the PTFE fiber formed from the second solid material can be enhanced accordingly.

In the method 2, the PTFE particles may be bound to each other in a temperature range equal to or higher than T° C. in terms of the temperature of the dispersion.

In the method 2, the second solid material is obtained by allowing the PTFE particles to collide with each other so that the heat generated by the collision raises the temperature of the dispersion and the temperature of the dispersion falls within the specific range. However, a heat source, such as a heating apparatus, other than the heat generated by the collision of the particles may be used in order to allow the dispersion to have a temperature within the specific range.

In the methods 1 and 2, the method for applying the mechanical force to the dispersion is not particularly limited, and the following methods can be used, for example.

A. Supplying the dispersion to a chamber in order to apply the force in the chamber.

B. Spraying the dispersion to a target in order to apply the force.

C. Allowing the dispersion to contact with a barrier, which inhibits a flow of the dispersion and is disposed in a flow path of the dispersion, in order to apply the force.

In the method A, the pressure generated in the chamber when the dispersion is supplied thereto allows the PTFE particles to collide with each other in a more reliable manner. Also, the thermal energy generated by the collision of the particles can be used more effectively to raise the temperature of the dispersion. As will be described later, a pipe (a first pipe) for discharging the solid material formed in the chamber can be connected to the chamber in the method A, making it easier to form the string-shape second solid material.

In the method A, the dispersion supplied to the chamber may be sprayed in the chamber (method A1) or made to pass through a narrowed space provided in the chamber (method A2).

In the method A1, the dispersion may be sprayed, for example, toward an inner wall of the chamber or a substance present in the chamber. By allowing the dispersion to collide with the inner wall or the substance, it is possible to convert the kinetic energy that the particles have into thermal energy and raise the temperature of the dispersion.

In the method A1, it also is possible to allow the dispersion to collide with the solid material formed in the chamber, depending on the structure and the shape of the chamber and the conditions for spraying the dispersion. In this case, the PTFE phase, which is obtained by allowing the PTFE particles to be bound to each other, can be formed in a more reliable manner, and the temperature of the dispersion can be raised in a more reliable manner.

The dispersion may be sprayed through a nozzle having a spraying orifice, and the structure and the shape of the nozzle, for example the form of its spraying orifice, may be determined arbitrarily. Similarly, to carry out the method B, the dispersion may be sprayed through a nozzle having a spraying orifice. Although the target for the method B may be defined arbitrarily, the space to have the target disposed therein preferably is sealed tightly to inhibit scattering of the sprayed dispersion and to increase the proportion of the amount of the obtained solid material to the amount of the sprayed dispersion.

The pressure at which the dispersion is sprayed may be determined arbitrarily according to the conditions such as the content of the PTFE particles and that of the surfactant in the dispersion, and the shape and the inner volume of the chamber. It should be noted, however, that an excessively low spray pressure may cause difficulty in obtaining the second solid material.

The method A2 may be carried out without particularly limiting the shape of the narrowed space through which the dispersion passes, and for example, it may be in the form of a slit.

It is possible to supply the dispersion to the chamber through a plurality of feeders so that the dispersions supplied from the plurality of feeders collide with each other in the chamber (method A3).

In order to cause the dispersions to collide with each other in the chamber, the dispersions may be sprayed through the nozzles respectively disposed at ends of the plurality of feeders, for example. In this case, the dispersions efficiently can collide with each other when at least two nozzles are disposed in the chamber with their spray directions crossing each other.

The method C may be carried out to apply the force by, for example, supplying the dispersion to a pipe (a second pipe) having the barrier. When the dispersion passes through the barrier disposed in the flow path (the second pipe), the flow of the dispersion may be turbulent or the dispersion may be partly stagnant, generating imbalanced pressures in the dispersion. Thereby, the force generated by the collision of the PTFE particles is applied to the dispersion, and the temperature of the dispersion can be raised.

The barrier may be, for example, a plate-like member, disposed inside the second pipe to create a narrow flow path therein. The barrier also may be formed by bending the second pipe, or by partially reducing the inner diameter of the second pipe. More specifically, the barrier also may be a bent portion or the narrowed space of the second pipe, and in this case, the method C also can be described as a method of supplying the dispersion to the second pipe having the bent portion or the narrowed space and then applying the force at the bent portion or the narrowed space.

The dispersion may be supplied to the second pipe by spraying the dispersion from the nozzle, and in this case, the force generated by the collision of the PTFE particles can be applied efficiently to the dispersion. The nozzle used for spraying may be the same as that used in the method A1, and the pressure at which the dispersion is sprayed from the nozzle may be determined arbitrarily according to the content of the PTFE particles and that of the surfactant in the dispersion, the shape of the second pipe, etc.

The method C also allows the dispersion to collide with the solid material formed in the second pipe, depending on the structure and shape of the second pipe and the conditions under which the dispersion is supplied.

The shape, the inner diameter, and the length of the second pipe and the shapes of the bent portion and the narrowed space are not particularly limited.

Use of the second pipe makes it easier to form the string-shape second solid material.

The methods A1 through A3, and the method B and the method C are examples of the method for applying the force to the dispersion of PTFE particles, and the methods 1 and 2 are not limited to the cases using the methods listed above.

The structure of the chamber, such as the shape and the inner volume, for applying the force to the dispersion is not particularly limited, and commercially available devices (such as "Ultimizer" manufactured by Sugino Machine Ltd.) may be utilized. "Ultimizer" is originally an atomizing dispersion device for pulverizing and atomizing various materials, such as pigments, fillers and catalysts, and the application for obtaining the PTFE-containing solid material containing water and a surfactant was found by the present inventors.

Figure 3:
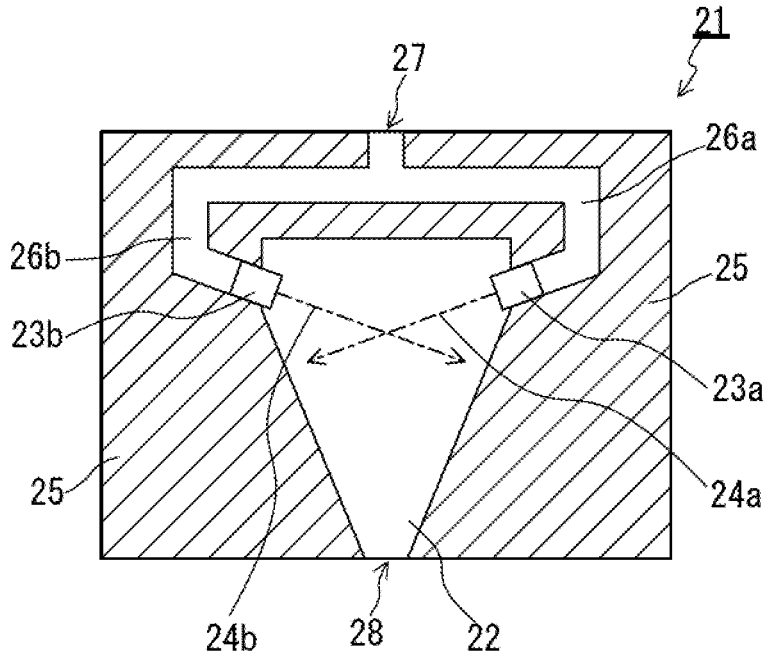
FIG. 3 is a schematic view showing an example of a chamber for forming a PTFE-containing solid material that can be used in the method for producing the PTFE fiber of the present invention.

FIG. 3 shows an example of the chamber. A chamber 21 shown in FIG. 3 has an inside space 22 in an approximately conical shape, which is cut off in the periphery near the bottom face, and a pair of nozzles 23*a* and 23*b* for spraying dispersions are disposed in the periphery so that their spraying orifices face the inside space 22. The nozzles 23*a* and 23*b* are located so that respective spray directions 24*a* and 24*b* intersect with each other. The dispersions can be supplied to the nozzles 23*a* and 23*b* from a feed opening 27 through feeders 26*a* and 26*b* formed inside of a structure 25 of the chamber 21. Near the apex of the inside space 22 in an approximately conical shape, an outlet 28 is formed to discharge the solid material formed in the chamber 21 (in the inside space 22). The shape of the outlet 28 is not particularly limited. For example, it may be circular, and in this case, the string-shape second solid material with a circular cross section can be discharged from the chamber 21.

The chamber 21 shown in FIG. 3 supplies the pressurized dispersions to the nozzles 23*a* and 23*b* through the feed opening 27 and the feeders 26*a* and 26*b* to spray the dispersions into the inside space 22 so that the sprayed dispersions collide with each other (the method A3 is realized). In addition, using a chamber 21 having a similar structure in which only one nozzle is provided or the spray directions 24*a* and 24*b* of the nozzles 23*a* and 23*b* are controlled, the dispersions can be sprayed into the inside space 22 to collide with an inner wall of the chamber 21 (a wall of the inside space 22) (the method A1 is realized).

The chamber 21 preferably has a sealable structure, and sealing the chamber 21 as needed enables the force to be applied more efficiently to the dispersions. The chamber 21 may have an opening for pressure regulation as needed for regulating the pressure in the inside space 22, and the opening for pressure regulation may have, for example, a pressure regulator valve disposed therein. The same applies to each chamber 21 shown in FIG. 4 to FIG. 6 below.

Figure 4:
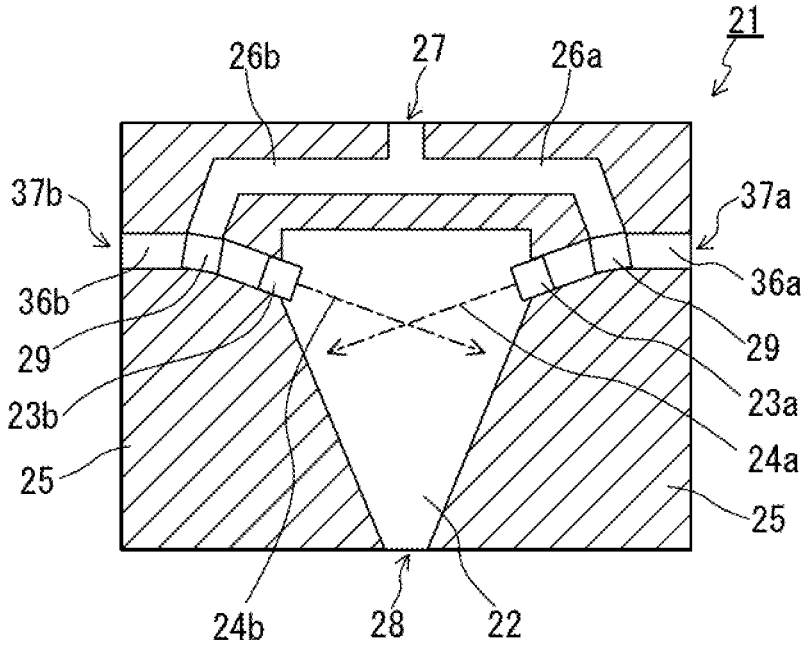
FIG. 4 is a schematic view showing another example of the chamber for forming the PTFE-containing solid material that can be used in the method for producing the PTFE fiber of the present invention.

The method for supplying the pressurized dispersions to the nozzles 23*a* and 23*b* is not particularly limited, and for example, the undivided dispersion pressurized by a high pressure pump may be supplied from the feed opening 27. Using the chamber 21 as shown in FIG. 4, the dispersions and water pressurized by a pump (pressurized water) may be supplied to mixing valves 29 formed right before the nozzles 23*a* and 23*b* through separate feeders and then mixed with the mixing valve 29 to be supplied to the nozzles 23*a* and 23*b*. In the chamber 21 shown in FIG. 4, the pressurized water is supplied to the mixing valves 29 through the feed opening 27 and the feeders 26*a* and 26*b*, and the dispersions are supplied to the mixing valves 29 through feed openings 37*a* and 37*b*, and feeders 36*a* and 36*b*.

Figure 5:
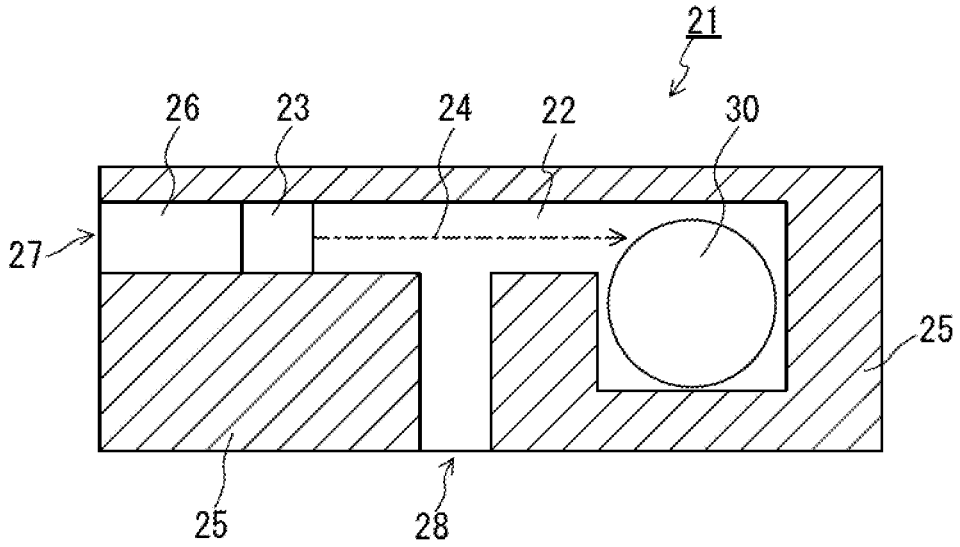
FIG. 5 is a schematic view showing still another example of the chamber for forming the PTFE-containing solid material that can be used in the method for producing the PTFE fiber of the present invention.

FIG. 5 illustrates another example of the chamber. The chamber 21 shown in FIG. 5 has the inside space 22 where a freely rotatable sphere 30 is disposed at one end and a nozzle 23 for spraying the dispersion is disposed at another end so that a spraying orifice of the nozzle 23 faces the inside space 22. The nozzle 23 and the sphere 30 are located so that a spray direction 24 of the nozzle 23 intersects with the sphere 30. The dispersion is supplied to the nozzle 23 from the feed opening 27 through a feeder 26 formed inside the structure 25 of the chamber 21. On a wall of the inside space 22 between the nozzle 23 and the sphere 30, the outlet 28 is formed to discharge the solid material formed in the chamber 21 (in the inside space 22).

The chamber 21 shown in FIG. 5 supplies the pressurized dispersion to the nozzle 23 through the feed opening 27 and the feeder 26 and the dispersion is sprayed into the inside space 22 to collide with the sphere 30, which is a component disposed in the chamber 21 (a substance in the chamber 21) (the method A1 is realized). At this time, by disposing the nozzle 23 and the sphere 30 in such a manner that the spray direction 24 of the nozzle 23 strays from the center of the sphere 30, a spray of the dispersion can rotate the sphere 30. Thereby, the abrasion inside the chamber 21 due to the collision of the dispersion can be suppressed.

For the sphere 30, a material that is not deformed by the collision of the dispersion preferably is used. For example, the sphere 30 may be made of a material such as ceramic, metal (preferably an alloy with a high hardness), and diamond.

Figure 6:
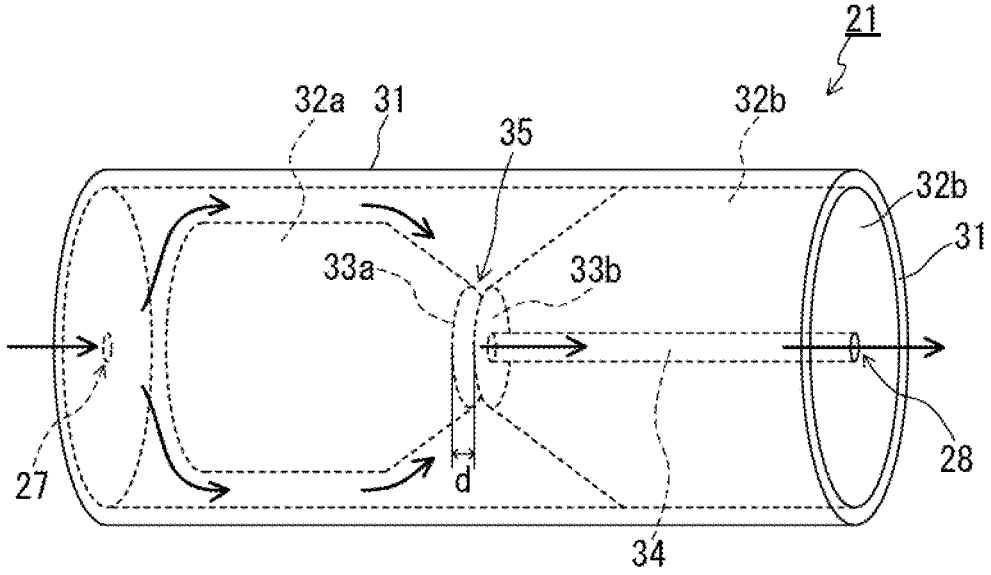
FIG. 6 is a schematic view showing still another example of the chamber for forming the PTFE-containing solid material that can be used in the method for producing the PTFE fiber of the present invention.

FIG. 6 shows another example of the chamber. The chamber 21 shown in FIG. 6 has a cylindrical outer case 31 accommodating a pair of inner units 32*a* and 32*b*. Each of the inner units 32*a* and 32*b* has the shape of a truncated cone joined on one end of a cylindrical column, and upper faces 33*a* and 33*b* of the truncated cones of the both inner units are disposed to face each other at a certain interval d. Central axes of the outer case 31 and the inner units 32*a* and 32*b* are substantially co-linear. At one end of the outer case 31, the feed opening 27 is formed to supply the dispersion. The inner unit 32*a*, which is closer to the feed opening 27, has an outer diameter smaller than an inner diameter of the outer case 31, whereas the inner unit 32*b*, which is farther from the feed opening 27, has an outer diameter equal to the inner diameter of the outer case 31. In addition, the inner unit 32*b* has an outlet channel 34 that is formed through an inside of the inner unit 32*b* from the center of the upper face 33*b* to the outside of the chamber 21. The inner unit 32*a* is supported by the outer case 31 through a support component (not shown).

By adjusting the location of the inner units 32*a* and 32*b* and controlling appropriately the interval d, it is possible to define a gap 35 between the upper faces 33*a* and 33*b* as a slit-shape narrowed space, and by supplying the pressurized dispersion to the chamber 21 from the feed opening 27, it is possible to allow the dispersion to pass through the narrowed space (the gap 35) formed in the chamber (the method A2 is realized). The dispersion passes through the gap 35 and then flows into the outlet channel 34 to be discharged from the outlet 28 of the chamber 21 as the second solid material.

The pressure of the dispersion to be supplied (supply pressure) may be determined arbitrarily according to the shape and the inner volume of the chamber, the length of the interval d, and the amount of the dispersion to be supplied. It should be noted, however, that it may be difficult to obtain the second solid material when the supply pressure is excessively low.

Preferably, in each of the chambers 21 shown in FIGS. 3 to 6, a pipe (a first pipe) is connected to the outlet 28, and the second solid material is discharged from the connected pipe while the second solid material is kept in contact with an entire inner wall of the pipe. This makes it possible further to apply the force that allows the PTFE particles to be bound to each other when the second solid material discharged from the outlet 28 passes through the first pipe, and to obtain a solid material with more excellent self-forming maintainability and enhanced mechanical properties such as strength. Connecting the first pipe to the chamber makes it easier to form the string-shape second solid material, and makes it possible to form the string-shape second solid material having, in the vicinity of an outer circumferential surface thereof, a skin layer in which the PTFE particles are bound to each other. For discharging the second solid material while keeping it in contact with the entire inner wall of the pipe, the shape and the diameter of the outlet 28, and the shape, the inner diameter, and the length of the pipe are selected appropriately.

The shape, the inner diameter, and the length of the first pipe to be connected are not particularly limited, and they may be determined arbitrarily according to the shape and the inner volume of the chamber 21 and the amount of the dispersion supplied to the chamber 21. Since the self-forming maintainability and mechanical properties of the obtained solid material tend to be more enhanced for a longer pipe basically, the length of the pipe preferably is larger than the minimum inner diameter of the pipe. As an example, when the processing speed of the dispersion is in the range of approximately 0.1 L/min to 0.5 L/min, the inner diameter of the pipe connected to the chamber 21 may be in the range of approximately 1 mm to 10 mm, and the length of the pipe may be in the range of approximately 1 mm to 5000 mm. In the case of the chamber 21 shown in FIG. 6, the outlet channel 34 may function as the pipe depending on the shape of the outlet channel 34.

In order to apply the force to the solid material more effectively, the minimum inner diameter of the first pipe preferably is equal to or less than the diameter of the outlet 28. Also, the pipe may be a pipe having an inner diameter that changes gradually as it extends from the outlet 28 (i.e. a pipe inside of which is tapered), and in this case, the inner diameter decreases gradually as it extends from the outlet 28.

The methods 1 and 2 can increase the degree of freedom in the shape of the obtained second solid material. For example, they can form the string-shape solid material with an average diameter exceeding 1 mm but not more than 5 cm approximately.

When the string-shape solid material is formed by the methods 1 or 2, the average diameter thereof can be adjusted by selecting, for example, the diameter of the outlet 28, the (minimum) inner diameter of the first pipe to be connected to the outlet 28, and the (minimum) inner diameter of the second pipe.

The methods 1 and 2 make it possible to obtain continuously the second solid material by applying continuously the force to the dispersion. That is, the second solid material can be obtained by a continuous production process, instead of a batch production process. For this purpose, the dispersion may be supplied continuously to the chamber 21 shown in FIGS. 3 to 6 so that the second solid material continuously is discharged from the chamber 21. Or, for example, the dispersion may be supplied continuously to the second pipe used in the method C so that the second solid material continuously is discharged from the second pipe.

The production method of the present invention makes it possible to produce continuously the PTFE fiber from the PTFE dispersion, which is a starting material, by reducing continuously the amount of the water contained in the second solid material formed continuously as mentioned above, and then drawing continuously the second solid material at a temperature equal to or higher than the melting point. Similarly, the PTFE fiber continuously can be produced from the starting material PTFE dispersion also when the second solid material continuously is drawn through the second die before the amount of the water contained in the second solid material is reduced.

In the methods 1 and 2, when the chamber or the pipe has no point of entry or exit for the material other than the feed opening and the outlet, the second solid material discharged from the chamber or the pipe can have substantially the same mass as that of the dispersion supplied to the chamber or the pipe. In early stages of such continuous production, there are cases where liquid flows out of the chamber, presumably due to an insufficient force applied to the dispersion. However, once the applied force becomes sufficient and stable after this initial stage, the entire amount of the dispersion turns into the second solid material. From this point in time, the mass of the supplied dispersion will be the same as the mass of the second solid material formed, excluding a trace amount of water that evaporates from the second solid material after the discharge. In this manner, according to the methods 1 and 2, substantially all of the solid-containing liquid-phase starting material (the dispersion) can turn into a solid-phase solid material (the second solid material). Thus, forming the second solid material by the methods 1 and 2 makes the production method of the present invention a highly-effective method for producing the PTFE fiber.

The content of the PTFE particles in the dispersion is not particularly limited. The lower limit thereof is, for example, 40 mass % or more, and preferably exceeds 40 mass %, more preferably exceeds 45 mass %, further preferably 50 mass % or more, and even more preferably 55 mass % or more, in order to form the second solid material with an excellent balance of self-forming maintainability and deformability. For the same reason, and taking into consideration the stability of the dispersion, the upper limit of the PTFE particle content is, for example, 70 mass % or less, and more preferably 65 mass % or less.

Depending on the method and conditions to apply the force to the dispersion, the self-forming maintainability of the second solid material formed tends to be enhanced as the content of the PTFE particles in the dispersion increases, and the deformability of the second solid material formed tends to be enhanced as the content of the PTFE particles decreases.

Generally, the average particle diameter of the PTFE particles is in the range of 0.1 μm to 40 μm, and preferably in the range of 0.2 μm to 1 μm.

The content of the surfactant in the dispersion is not particularly limited. In order to obtain the second solid material with the excellent balance of self-forming maintainability and deformability, the content of the surfactant in the dispersion preferably is in the range of 0.01 mass % to 15 mass %, more preferably in the range of 0.1 mass % to 10 mass %, further preferably in the range of 1 mass % to 9 mass %, even more preferably in the range of 1.5 mass % to 9 mass %, and yet more preferably in the range of 2 mass % to 7 mass %. With the surfactant content in the preferable ranges, the second solid material readily can be obtained while suppressing separation of the PTFE phase from the water phase.

The type of the surfactant is not particularly limited in the method 1. In the method 2, the type of the surfactant is not particularly limited as long as it is nonionic. For example, polyoxyethylene alkyl ether, a polyoxyethylene derivative, glycerol fatty acid ester, etc. can be used as the surfactant in both of the methods 1 and 2.

The surfactant used in each of the methods 1 and 2 preferably is a surfactant that is decomposed in the temperature range of approximately 100° C. to the melting point of PTFE.

In this case, it is possible to reduce the amount of the surfactant remaining in the PTFE fiber formed, when the drawing is performed at a temperature equal to or higher than the melting point.

A commercially available PTFE dispersion may be used as the dispersion. The commercially available PTFE dispersion may be, for example, one of AD series, such as AD938, AD911, AD912, AD1, AD639 and AD936, manufactured by Asahi Glass Co., Ltd. (formerly Asahi Glass Fluoropolymers Co., Ltd.) and one of the D series, such as D1, D2 and D3, manufactured by Daikin Industries Ltd. Generally, these commercially available PTFE dispersions contain a nonionic surfactant.

The dispersion may contain a substance other than the PTFE particles, water, and surfactant.

The PTFE fiber of the present invention is a fiber obtained by drawing the string-shape PTFE-containing solid material (the first solid material) at a temperature equal to or higher than the melting point of PTFE so as to reduce the diameter of the solid material.

The PTFE fiber of the present invention can be obtained by the above-mentioned production method of the present invention, for example.

Typically, the PTFE fiber of the present invention is composed of a fused portion of PTFE extended in an axial direction of the fiber. For example, the fiber of the present invention described in the below-mentioned Example has at least two of the fused portions of PTFE that are extended in the axial direction of the fiber and arranged parallel to each other. The fused portions are fused to each other on their side surfaces. The fused portion has an average diameter of 0.1 μm to 5 μm, which is larger than an average diameter (generally 0.02 μm to 0.1 μm) of fibrils observed in a conventional PTFE fiber.

In the PTFE fiber of the present invention, it seems that the high orientation of PTFE molecular chains is achieved by the drawing at a temperature equal to or higher than the melting. For example, a degree of crystal orientation in the axial direction of the fiber resulted from a wide angle X-ray diffraction (WAXD) measurement is 0.92 or more. It may exceed 0.93, and further may be 0.99 or more, and 0.995 or more.

In the PTFE fiber of the present invention, it seems that the fused portions make it possible to realize high mechanical properties. For example, a tensile modulus resulted from a tensile test is 10 GPa or more. It may be 20 GPa or more, and further may be 30 GPa or more, and 40 GPa or more.

The PTFE fiber of the present invention in another aspect is formed of PTFE because it contains neither matrix material nor decomposing materials thereof. The degree of crystal orientation in the axial direction of the fiber resulted from the WAXD measurement is 0.92 or more.

The PTFE fiber of the present invention in another aspect is formed of a fused portion of PTFE extended in the axial direction of the fiber.

EXAMPLES

Hereinafter, the present invention will be described in more detail with reference to Example. The present invention is not limited to the following Example.

First, examples of the method for forming the PTFE-containing solid material (the second solid material) will be described as forming examples.

Forming Example 1

In Forming Example 1, the string-shape second solid material was formed using the chamber 21 shown in FIG. 3 and AD938 (the content of PTFE particles is 60 mass % of the content of PTFE particles, the average particle diameter of the PTFE particles is 0.3 μm, the content of a surfactant is 3 mass %) produced by Asahi Glass Co., Ltd., which is a commercially available PTFE dispersion, as the dispersion. The surfactant contained in the AD938 is a nonionic surfactant with a clouding point of approximately 60° C.

The volume of the inside space 2 of the chamber 21 (the inner volume of the chamber 21) was 200 $cm^3$, and a pair of the nozzles 23*a* and 23*b*, each having a circular spraying orifice (0.25 mmϕ)), were disposed in the chamber. Diamond was used for a part where the spraying orifice was formed at a head of the nozzle, and the nozzles 23*a* and 23*b* were disposed so that the respective spraying directions 24*a* and 24*b* of the nozzles intersected with each other. The pipe (the first pipe) with a circular cross section was connected to the outlet 28 (with a circular shape, 10 mm in diameter). The pipe had an inner diameter of 1.6 mm and a length of 1000 mm.

The dispersion (at a temperature of 25° C.) was supplied to the chamber 21, and the dispersion was sprayed from the nozzles 23*a* and 23*b*. The amount of the supplied dispersion was approximately 0.5 L/min and the spray pressure for the dispersion was 200 MPa. No heating was applied to the chamber 21 and the dispersion.

Ten or so seconds after the start of spraying, the string-shape (cylindrical shape) PTFE-containing solid material (2 mm in diameter) was discharged from an end of the pipe. The discharged solid material contained water and the surfactant, and maintained its shape successfully without a support.

The solid material discharged from the end of the pipe was measured for temperature. As a result, the temperature was stabilized at around 70° C. after approximately 40 seconds from the start of spraying. In the chamber 21, the temperature at which the dispersion turned into the solid material seemed to be equal to or higher than this temperature. That is, in this experiment, it seems that the PTFE particles were bound to each other in a temperature range of 70° C. or higher in terms of the temperature of the dispersion.

A similar experiment was conducted by varying the diameter of the spraying orifice of the nozzle in the range from 0.05 mmϕ to 0.5 mmϕ, the spray pressure for the dispersion in the range from 30 MPa to 300 MPa, and the amount of the supplied dispersion in the range from 0.3 L/min to 10 L/min. As a result, the second solid material was formed as in the above experiment.

Forming Example 2

Figure 7:
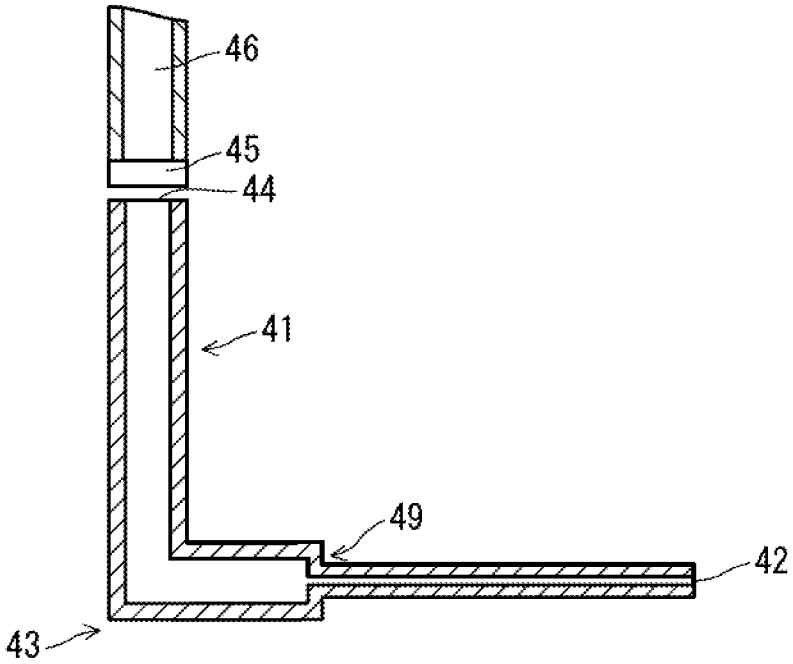
FIG. 7 is a schematic view for illustrating a second tube used for forming a PTFE-containing solid material (a second solid material) in Forming Example, and a method for forming the PTFE-containing solid material by the second tube.

In Forming Example 2, the string-shape second solid material was formed using the AD938 produced by Asahi Glass Co., Ltd. as the dispersion, and a pipe (a second pipe) 41 shown in FIG. 7. The pipe 41 had an L-shaped bent portion 43 and a narrowed portion 49 at which the inner diameter of the pipe 41 is changed, each serving as a barrier inhibiting the flow of the dispersion. The pipe 41 had an inner diameter of 10 mm on the upstream from the narrowed portion 49 and an inner diameter of 2 mm on the downstream from the narrowed portion 49. The narrowed portion 49 was located 200 mm away from an end (an outlet side end) 42 of the pipe 41. The bent portion 43 was located 170 mm away from another end (an inlet side end) 44 of the pipe 41.

The pipe 41 and a nozzle 45 (with a 0.15 mmϕ circular spraying orifice) disposed at an end of a feeder 46 of the dispersion were arranged so that the nozzle 45 is located on a central axis of the pipe 41 and a distance between the another end 44 of the pipe 41 and the nozzle 45 was 5 mm (see FIG. 7), and then the dispersion was sprayed into the pipe 41 from the nozzle 45. The amount of the dispersion supplied to the nozzle 45 was approximately 0.5 L/min, the temperature of the dispersion was 25° C., and the spray pressure for the dispersion was 200 MPa. No heating was applied to the pipe 41 and the dispersion.

Several seconds after the start of spraying, the string-shape PTFE-containing solid material (2 mm in diameter) was discharged from the end 42 of the pipe 41. The discharged solid material contained water and the surfactant, and maintained its shape successfully without a support.

The solid material discharged from the end of the pipe was measured for temperature. As a result, the temperature was stabilized at around 70° C. after approximately 40 seconds from the start of spraying.

A similar experiment was conducted by varying the spray pressure for the dispersion in the range from 200 MPa to 240 MPa. As a result, the string-shape second solid material was formed as in the above experiment.

In addition, a similar experiment was conducted by varying the content of PTFE particles in the dispersion. As a result, the string-shape second solid material was formed as in the above experiment even when the content was 54 mass % and 48 mass %.

Figure 8:
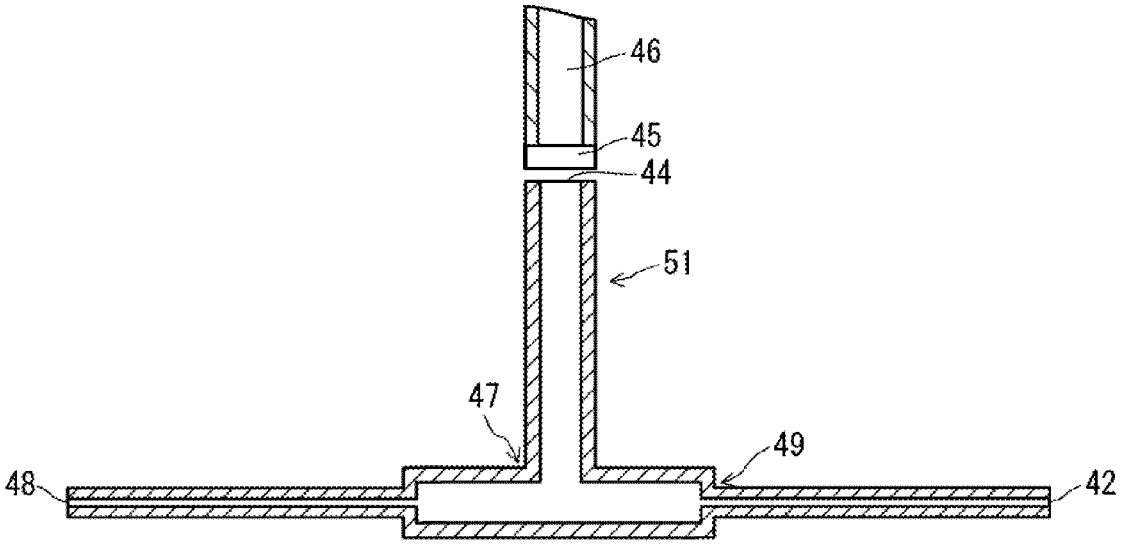
FIG. 8 is a schematic view for illustrating a second tube used for forming the PTFE-containing solid material (the second solid material) in the Forming Example, and a method for forming the PTFE-containing solid material by the second tube.
Figure 9:
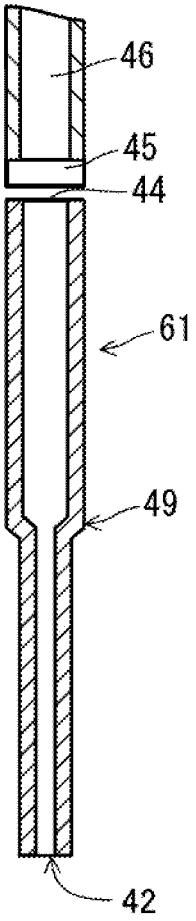
FIG. 9 is a schematic view for illustrating a second tube used for forming the PTFE-containing solid material (the second solid material) in the Forming Example, and a method for forming the PTFE-containing solid material by the second tube.

The string-shape second solid material also was formed as in the above experiment also when a similar experiment was conducted using a pipe (a second pipe) 51 shown in FIG. 8 and a pipe (a second pipe) 61 shown in FIG. 9.

The pipe 51 had an T-shaped bent portion 47 near the end 42 thereof as a barrier inhibiting the flow of the dispersion. The pipe 51 had an inner diameter of 10 mm and a length (a length from the end 42 to the another end 44) was 200 mm. The bent portion 47 was located 30 mm away from the end 42 of the pipe 51.

When the pipe 51 was used, the string-shape PTFE-containing solid material was discharged from the end 42, but the string-shape PTFE-containing solid material was not discharged from an end 48 constituting a "T-shaped" open end together with the end 42. This experiment was conducted a plurality of times, and, in each of the experiments, the string-shape PTFE-containing solid material was discharged from only one of the end 42 and the end 48.

The pipe 61 had the narrowed portion 49 at which an inner diameter of the pipe 61 is changed, as a barrier inhibiting the flow of the dispersion, at central part of the pipe 61 in a longitudinal direction. The pipe 61 was 400 mm long, and had an inner diameter of 2 mm from the end 42 to a position 200 mm away from the end 42 and an inner diameter of 10 mm from the another end to a position 200 mm away from the another end. That is, the inner diameter of the pipe 61 changes from 10 mm to 2 mm at the narrowed portion 49.

Example 1

First, the string-shape second solid material was formed as in the Forming Example 1. It should be noted, however, that the chamber 21 had an inner volume of 30 $cm^3$, and the first pipe with a circular cross section, an inner diameter of 1.6 mm, and a length of 200 mm was connected to the outlet 28 of the chamber 21, so as to form the string-shape (cylindrical) second solid material having a diameter of 2 mm.

Subsequently, the string-shape solid material thus formed was drawn through five of the second die whose discharge ports have a different diameter from each other, in warm water at 90° C. As a result, the diameter of the second solid material stepwise was reduced to 1.67 mm through the first second die, to 1.4 mm through the second die, to 1.2 mm through the third second die, to 1.0 mm through the fourth second die, and to 750 μm through the fifth second die. The five second dies were arranged in descending order of the diameter of the discharge port, and the string-shape second solid material was drawn through the dies in this order.

As each of the dies, a pipette tip (111-Q for 1000 μL, produced by Quality Scientific Plastics, Inc.) made of polypropylene was used. The second solid material was drawn through an opening provided at an end of the tip. An inside space near the opening of the tip, that is, a space with which the second solid material contacts, had almost a cone shape, and the die angle α, which is an angle between a central axis of the cone and a generatrix of a conic plane, was approximately 7°. In each of the die, the diameter of the second solid material drawn through the discharge port was almost the same as the diameter of the discharge port. The opening was formed by cutting an end of the pipette tip, and a diameter of the opening was adjusted by changing the cutting position. The second solid material was drawn at a drawing rate of 17.3 m/min.

Figure 10:
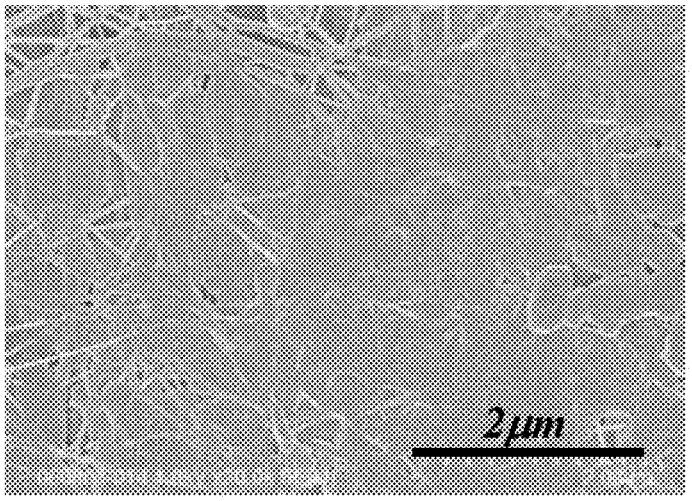
FIG. 10 is a view showing a scanning electron microscope (SEM) image taken in the vicinity of a surface of a cross section of the PTFE-containing solid material (the second solid material) produced in Example 1.
Figure 11:
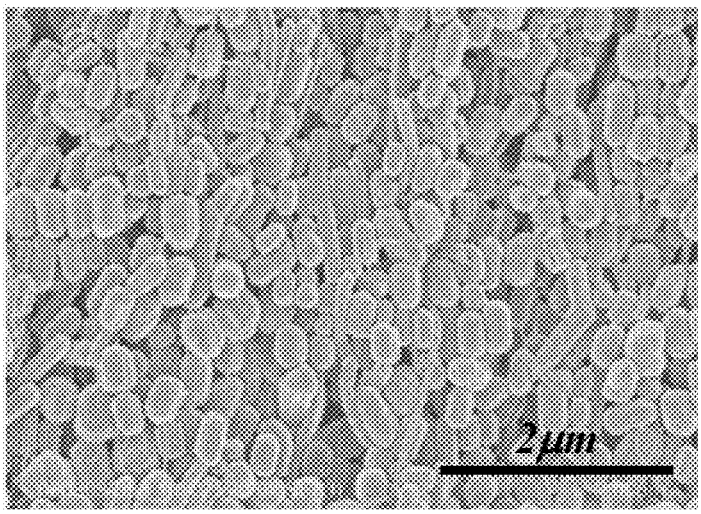
FIG. 11 is a view showing an SEM image taken near a center of the cross section of the PTFE-containing solid material (the second solid material) produced in Example 1.

FIG. 10 shows a scanning electron microscope (SEM) image of the second solid material before being drawn, taken in the vicinity of a surface (an outer circumferential surface) of a cross section (a cross section perpendicular to an extension direction) of the second solid material. FIG. 11 shows an SEM image of the second solid material before being drawn, taken near a center of the cross section. As shown in FIG. 10, the skin layer with a structure in which the PTFE particles are bound to each other was formed in a portion in the vicinity of the outer circumferential surface of the second solid material. In contrast, as shown in FIG. 11, the PTFE particles maintained their original shapes (shapes that they had had in the dispersion) near the center of the portion. Each of the SEM images was taken on the second solid material that had been dried and then freeze-broken. Conceivably, water and the surfactant are present stably among the particles shown in FIG. 11 when the second solid material contains water, and such a structure contributes to the achievement of deformability of the second solid material.

The cross section of the second solid material after being drawn in warm water was observed by an SEM. As a result, a large number of PTFE particles were found near the center of the cross section.

Subsequently, the solid material with a diameter reduced by the drawing was naturally dried (that is, the first solid material was obtained by reducing the amount of the water contained in the second solid material), and then the obtained first solid material was drawn at a drawing temperature of 350° C. through the first die 2 that was made of metal and had the cross-sectional shape shown in FIG. 12. As a result, the diameter of the solid material further was reduced to 210 μm, and a translucent fiber whose diameter (fiber diameter) was almost uniform throughout the one entire fiber was obtained. The cross-sectional shape of the fiber was almost circular, although slight projections and depressions were observed on a surface of the fiber.

Figure 12:
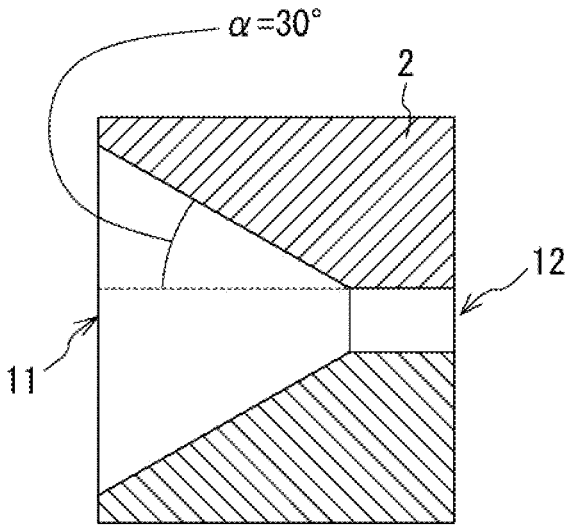
FIG. 12 is a cross-sectional view showing schematically a first die used in Example 1 and Example 2.

A part of a plane in the die 2 shown in FIG. 12 (a plane with which the first solid material contacts) was a conic plane of a cone with a central axis conforming to the extension direction of the solid material and a top being on a side of the direction in which the solid material is drawn. The die angle α, which is an angle between a central axis of the cone and a generatrix of the conic plane, was approximately 30°. The drawing was performed with the temperature of the die 2 at 350° C. and the drawing rate at 0.8 m/min. The fiber discharge port 12 of the die 2 had a diameter of 500 μm.

Figure 13A:
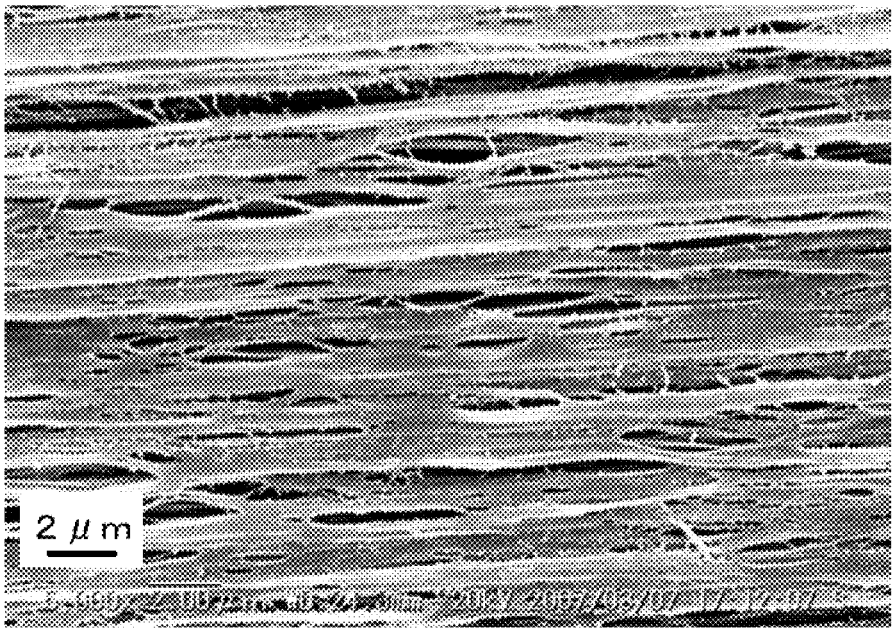
FIG. 13A is a view showing an SEM image of a cross section of a PTFE fiber formed in Example 1 by drawing (at a drawing temperature of 350° C.) through the first die.
Figure 13B:
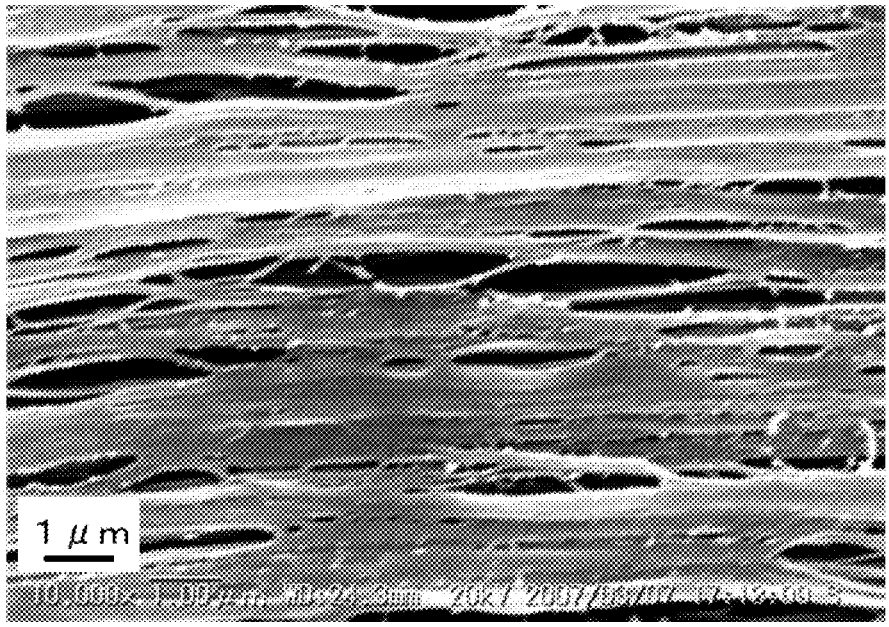
FIG. 13B is a view showing an SEM image of the cross section of the PTFE fiber formed in Example 1 by drawing (at a drawing temperature of 350° C.) through the first die.

FIG. 13A and FIG. 13B show respectively an SEM image of a cross section (a cross section parallel to the extension direction) of the fiber obtained by the drawing (at a drawing temperature of 350° C.) through the first die 2. The SEM images of FIG. 13A and FIG. 13B were taken on the same cross section but at different magnifications.

As shown in FIG. 13A and FIG. 13B, the PTFE fiber having a plurality of the PTFE fused portions extended in the axial direction of the fiber was formed by the drawing at a temperature equal to or higher than the melting point. An average diameter of the PTFE fused portions in the example shown in FIG. 13A and FIG. 13B was measured by image processing. As a result, the average diameter was in the range of approximately 0.5 μm to 3 μm. From the fact that a large number of the PTFE particles were present in the central portion of the solid material before this drawing, it seems that the drawing at a temperature equal to or higher than the melting point allowed the particles to be fused to each other so as to form the fused portions.

Separately, the first solid material was drawn in the same manner as described above, except for that the drawing temperature was 380° C. As a result, the diameter of the solid material further was reduced to 120 μm, and a fiber that had a diameter (a fiber diameter) almost uniform throughout the one entire fiber and was more translucent than the fiber obtained at a drawing temperature of 350° C. was produced. The cross-sectional shape in this case was almost circular as in the case where the drawing temperature was 350° C.

Figure 14A:
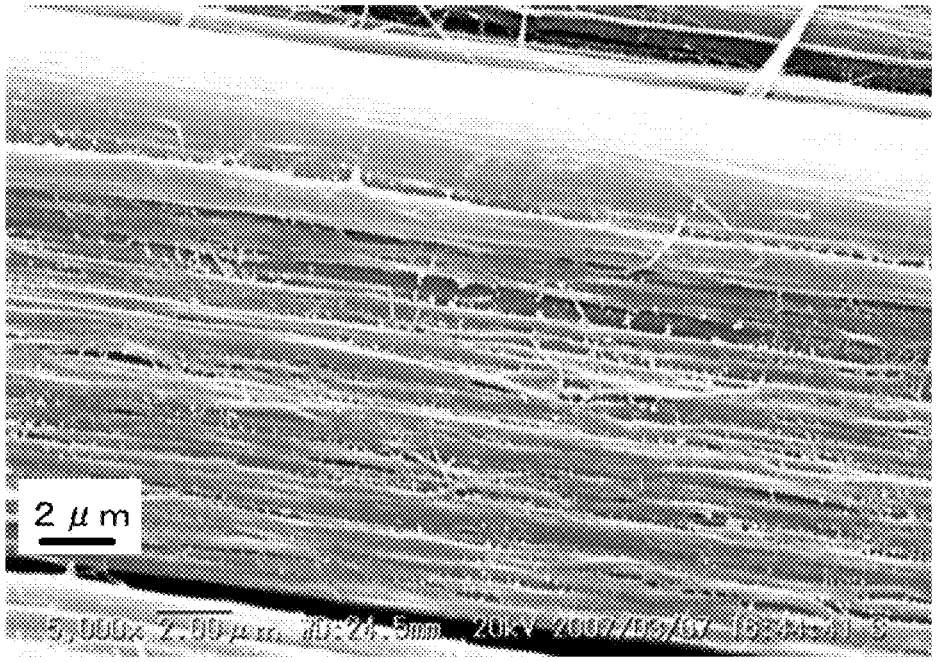
FIG. 14A is a view showing an SEM image of a cross section of a PTFE fiber formed in Example 1 by drawing (at a drawing temperature of 380° C.) through the first die.
Figure 14B:
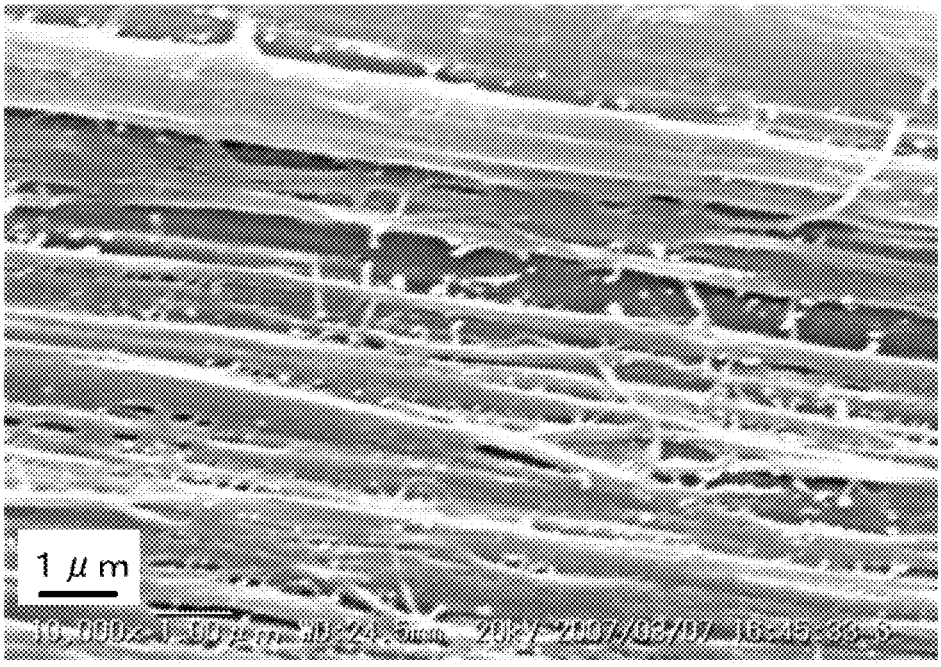
FIG. 14B is a view showing an SEM image of the cross section of the PTFE fiber formed in Example 1 by drawing (at a drawing temperature of 380° C.) through the first die.

FIG. 14A and FIG. 14B show respectively an SEM image of a cross section (a cross section parallel to the extension direction) of the fiber obtained by this drawing (at a drawing temperature of 380° C.). The SEM images of FIG. 14A and FIG. 14B were taken on the same cross section but at different magnifications.

As shown in FIG. 14A and FIG. 14B, the drawing at 380° C. formed also the PTFE fiber having a plurality of the PTFE fused portions extended in the axial direction of the fiber, as in the case where the drawing temperature was 350° C. In this fiber, the adjacent fused portions were fused to each other more closely, the number of the gaps among the fused portions was smaller, and the size of each of the gaps also was smaller than in the fiber obtained at a drawing temperature of 350° C. It seems that such a change in the state of the gaps made it possible to obtain the more transparent fiber than in the case where the drawing temperature was 350° C. The reason why the change in the state of the gaps occurred seems to be that the drawing at a higher temperature accelerated the fusion of PTFE.

Subsequently, a specific gravity of the fiber obtained as mentioned above was calculated from a weight of the fiber put in butanol having a good wettability against PTFE and a weight of the fiber put in air, at a temperature of 25° C. The result was approximately 2.22. Separately, for comparison, a specific gravity of Toyoflon (trade name) (produced by Toray Industries, Inc.), which is a commercially available PTFE fiber produced by the matrix spinning process, and a specific gravity of a fiber taken from a bag filter (PRISTYNE6230) produced by Gore, which is a PTFE fiber produced by the slit yarn process, were measured in the same manner as described above. As a result, the specific gravity of Toyoflon was approximately 1.90, and that of the fiber taken from the bag filter was approximately 2.06. This result suggests that the fiber of the present invention obtained by the drawing at a temperature equal to or higher than the melting point has a more "dense" structure than conventional PTFE fibers.

An attempt was made to evaluate the specific gravity of the PTFE fiber using water instead of butanol, but many air bubbles adhered to a surface of the fiber because of low wettability of water against PTFE. Thus, it was difficult to measure the specific gravity by using water.

Example 2

First, the string-shape second solid material (2 mm in diameter) was formed, the second solid material was drawn in warm water at 90° C. and then naturally dried to obtain the string-shape first solid material (750 μm in diameter), as in the Example 1.

Subsequently, the obtained first solid material was drawn through the first die 2 that was made of metal and had the cross-sectional shape shown in FIG. 12, at a drawing temperature of 250° C., 320° C., 330° C., 340° C., 350° C., 360° C., 370° C., or 380° C. Thus, the PTFE fibers were obtained. The drawings at a drawing temperature of 250° C. and 320° C. were performed for comparison. The fibers obtained at all of these drawing temperatures had a diameter almost uniform throughout the one entire fiber. The cross-sectional shapes of the fibers were almost circular, although slight projections and depressions were observed on surfaces of the fibers.

Each the fibers thus formed was evaluated for fiber diameter, color tone, tensile strength, elastic modulus, breaking elongation, degree of crystallization, and crystal orientation in the axial direction of the fiber. Hereinafter, the method for evaluating each of the evaluation items will be described.

[Fiber Diameter]

The fiber diameter was evaluated with a micrometer.

[Color Tone]

The color tone of the fiber was evaluated visually.

[Tensile Strength, Elastic Modulus, and Breaking Elongation]

These items were evaluated by conducting a tensile test on the fiber to be evaluated and measuring an S-S curve (a stress-strain curve) of the fiber. The tensile test was conducted using a tensile testing machine (CATY500BH produced by Yonekura MFG), at a tension rate of 50 mm/min., with the distance between chucks being 20 mm, and a measuring atmosphere at 22° C. In this test, the direction in which the fiber was pulled was the extension direction of the fiber.

[Degree of Crystal Orientation]

A wide angle X-ray diffraction (WAXD) measurement was conducted on the fiber to be evaluated, and the degree of crystal orientation of the fiber in the axial direction of the fiber was measured from the obtained X-ray diffraction image (WAXD pattern). The WAXD measurement was made using a wide angle X-ray diffractometer (produced by Rigaku Corp.), in which the fiber was irradiated with a CuKa ray (wavelength 0.1542 nm) and the diffraction image was recorded on a planar film. The direction of the X-ray radiation was perpendicular to the fiber axis of the fiber, and the X-ray irradiation was performed for 1.5 hours. The WAXD measurement was conducted at 22° C., which is higher than a temperature (19° C.) that allows PTFE to be hexagonal so that the degree of crystal orientation can be measured from one crystal face. The degree of crystal orientation measured from the obtained WAXD pattern was evaluated according to Fiber Handbook third edition (edited by the Society of Fiber Science and Technology, Japan, issued by Maruzen Co., Ltd. on December 15, year of Heisei 16 (2004), pp. 81 to 83). The degree of crystal orientation was calculated from (100) orientation.

[Degree of Crystallization]

A differential scanning calorimetry (DSC) measurement was conducted on the fiber to be evaluated, and the degree of crystallization of the fiber was measured from the obtained DSC curve. The DSC measurement was conducted with a differential scanning calorimeter (DSC3100SA produced by Bruker AX), using alumina for a standard sample of the measurement, under the measurement conditions that the rate of temperature increase was 10° C./min. and the flow rate of nitrogen was 50 mL/min. The degree of crystallization (Xc) of each fiber was determined by obtaining a fusion enthalpy ($\Delta H_f$) of the fiber from the DSC curve obtained by the measurement, and then calculating by the formula $Xc=(\Delta H_f/\Delta H_f^{100\%})\times 100(\%)$. Here, $\Delta H_f^{100\%}$ denotes the fusion enthalpy of a perfect crystal of PTFE. In this experiment, $\Delta H_f^{100\%}$ is defined as 92.9 J/g according to a description in "Starkweather H W Jr., Zoller P, Jones G A, Vega A J, et al., Journal of Polymer Science, Polymer Physics Edition, 1982, Vol. 20, pp. 751".

Figure 15:
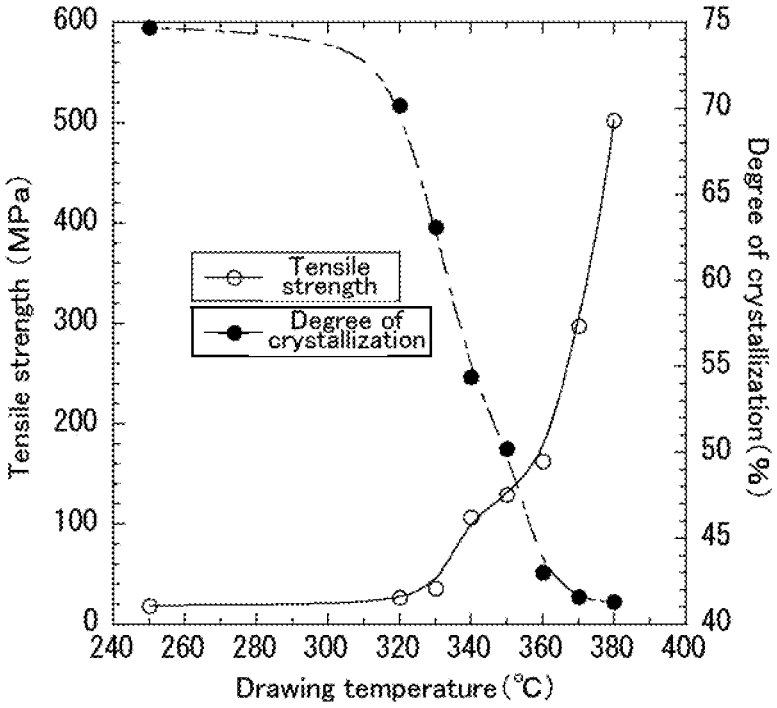
FIG. 15 is a view showing variations in tensile strength and degree of crystallization of an obtained fiber when the drawing temperature varies, evaluated in Example 2.
Figure 16:
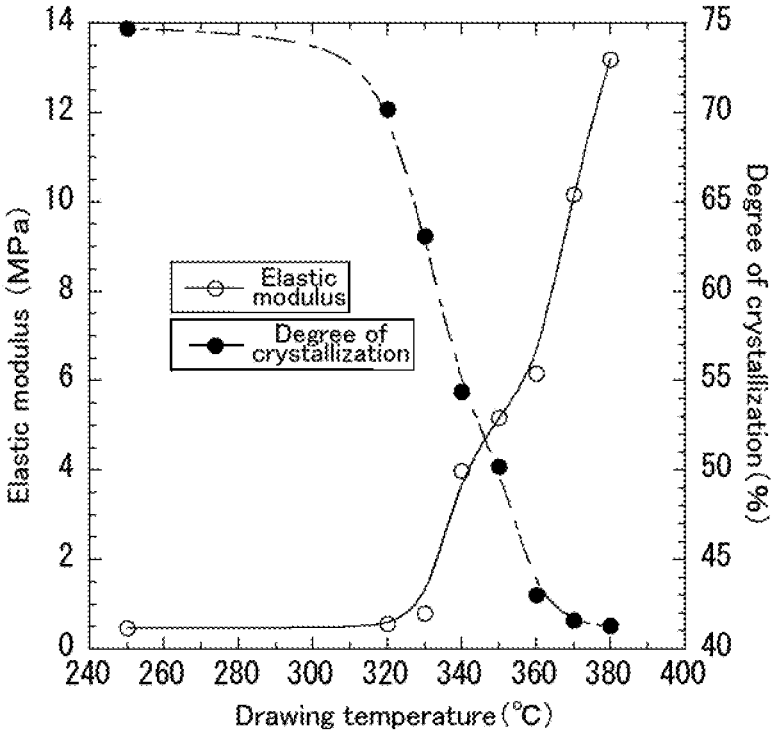
FIG. 16 is a view showing variations in elastic modulus and degree of crystallization of the obtained fiber when the drawing temperature varies, evaluated in Example 2.
Figure 17:
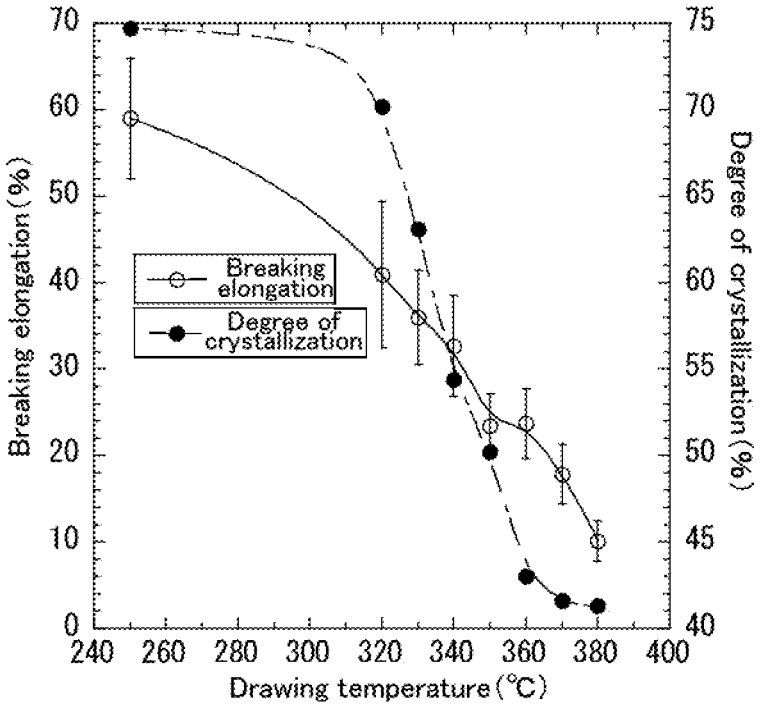
FIG. 17 is a view showing variations in breaking elongation and degree of crystallization of the obtained fiber when the drawing temperature varies, evaluated in Example 2.

Tables 1 below and FIGS. 15 to 17 show the evaluation results.

TABLE 1

| Drawing temperature (° C.) | Fiber diameter (mm) | Color tone | Degree of crystal orientation |
|---|---|---|---|
| 250 | 0.37 | White | 0.84 |
| 320 | 0.36 | White | 0.91 |
| 330 | 0.36 | White | 0.92 |
| 340 | 0.24 | White - translucent | 0.92 |
| 350 | 0.21 | Translucent (partially white) | 0.93 |
| 360 | 0.19 | Translucent (partially white) | 0.92 |
| 370 | 0.15 | Translucent | 0.99 |
| 380 | 0.12 | Translucent | 0.99 |

As shown in Table 1, there was a tendency for the obtained fiber to have a smaller fiber diameter when the drawing temperature was raised. Particularly, when the drawing temperature was 340° C. or higher, the fiber diameter of the obtained fiber significantly was smaller than when the drawing temperature was 330° C. or lower. In addition, there was a tendency for the color tone of the fiber to change gradually from white to translucent when the drawing temperature was 340° C. or higher.

As shown in Table 1 and FIGS. 15 to 17, there was a tendency for the obtained fiber to have a higher tensile strength, elastic modulus, and degree of crystal orientation when the drawing temperature was equal to or higher than the melting point of PTFE. On the other hand, breaking elongation and degree of crystallization were lower.

More specifically, the tensile strength and the elastic modulus of the fiber increased significantly when the drawing temperature was 330° C. or higher, particularly 340° C. or higher. The degree of crystallization began to decrease at a temperature lower than the above temperature range. Specifically, the degree of crystallization began to decrease at a drawing temperature of 320° C., from that measured at a drawing temperature of 250° C. In contrast, the breaking elongation of the fiber was less affected by whether the drawing temperature was equal to or higher than the melting point of PTFE than the tensile strength, etc. There was a general tendency for the breaking elongation to decrease when the drawing temperature increases in the drawing temperature range of 250° C. or higher. The degree of crystal orientation increased significantly when the drawing temperature was 370° C. or higher.

Figure 18:
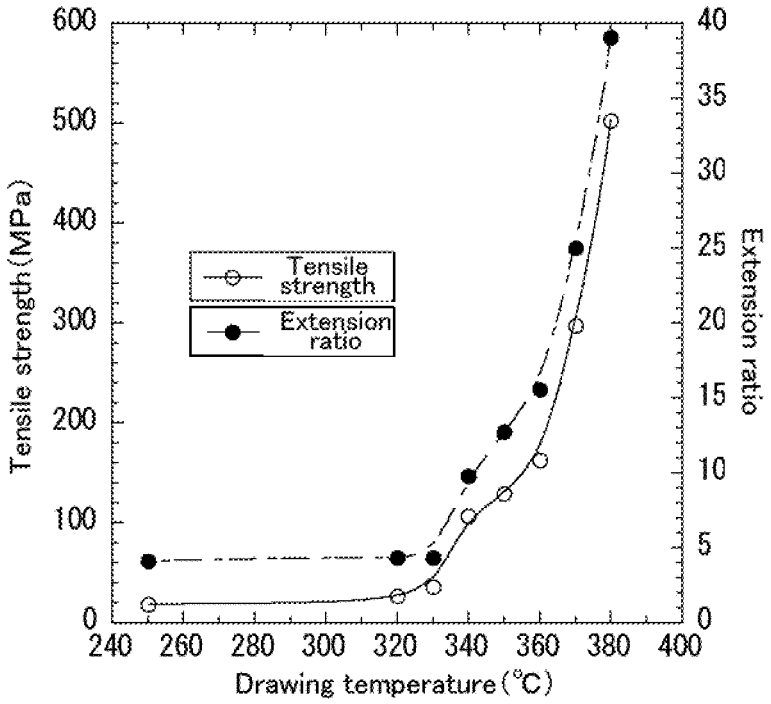
FIG. 18 is a view showing a variation in tensile strength of the obtained fiber and a variation in extension ratio at the time of drawing when the drawing temperature varies, evaluated in Example 2.
Figure 19:
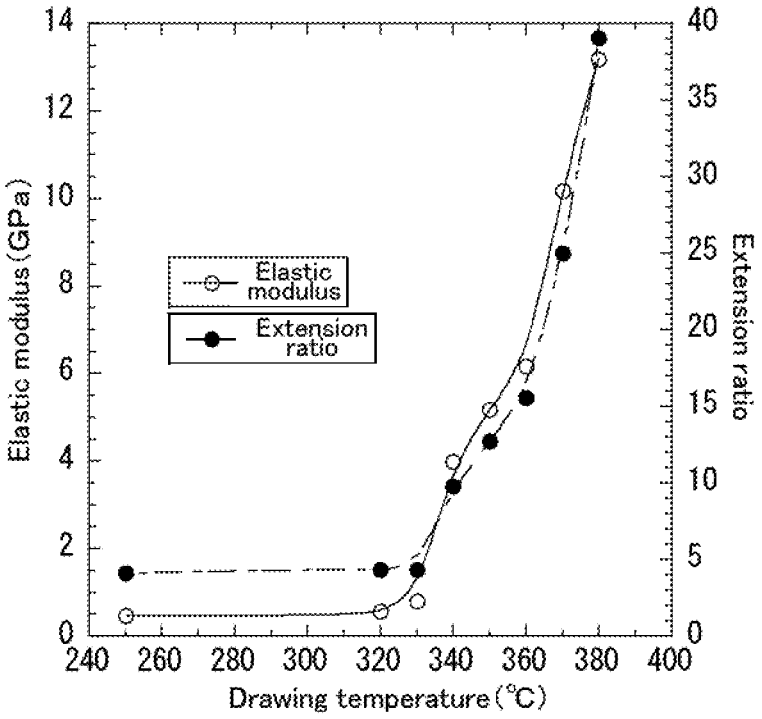
FIG. 19 is a view showing a variation in elastic modulus of the obtained fiber and a variation in extension ratio at the time of drawing when the drawing temperature varies, evaluated in Example 2.
Figure 20:
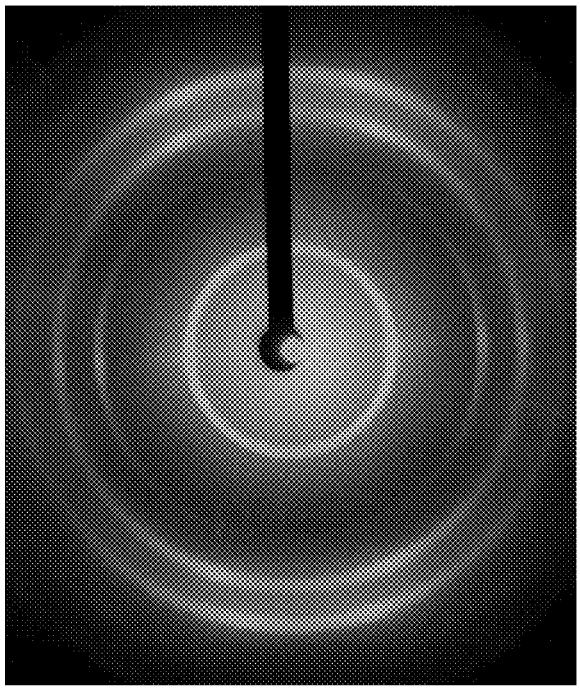
FIG. 20 is a view showing a WAXD pattern of the fiber formed in Example 2 by drawing (at a drawing temperature of 250° C.) through the first die.
Figure 21:
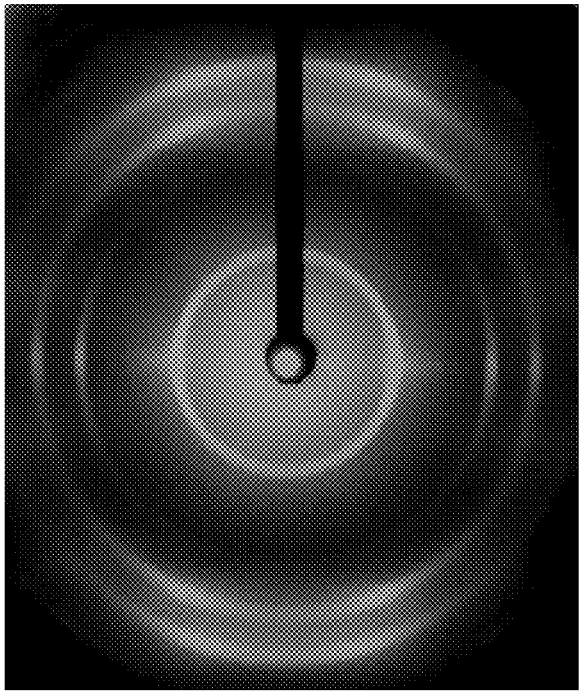
FIG. 21 is a view showing a WAXD pattern of the fiber formed in Example 2 by drawing (at a drawing temperature of 320° C.) through the first die.
Figure 22:
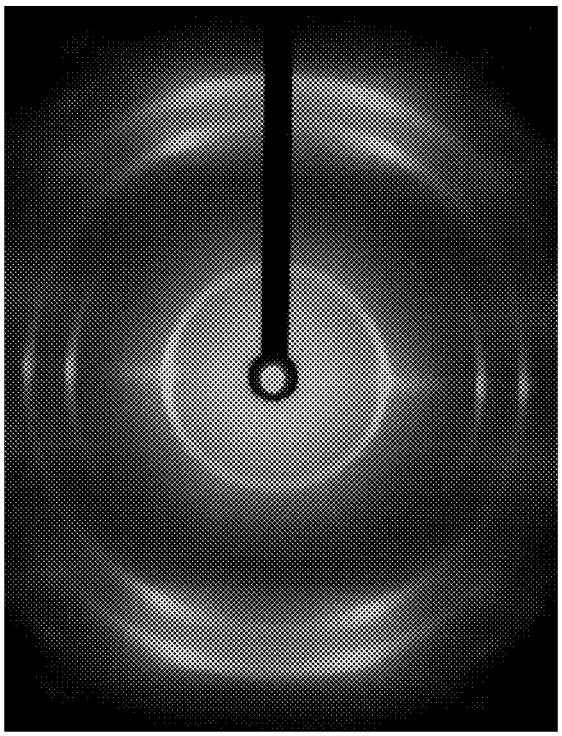
FIG. 22 is a view showing a WAXD pattern of the fiber formed in Example 2 by drawing (at a drawing temperature of 330° C.) through the first die.
Figure 23:
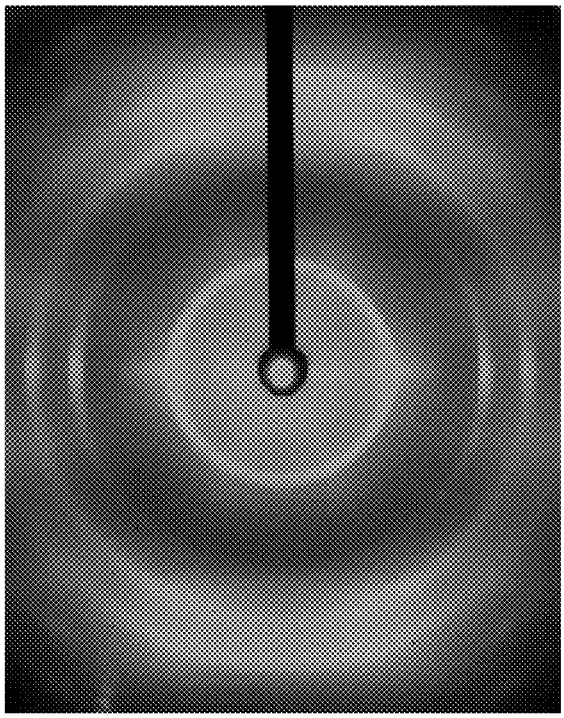
FIG. 23 is a view showing a WAXD pattern of the fiber formed in Example 2 by drawing (at a drawing temperature of 340° C.) through the first die.
Figure 24:
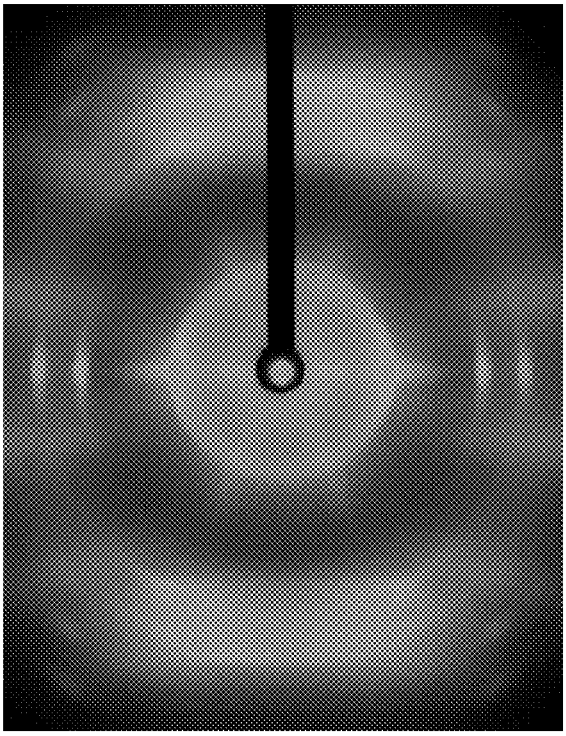
FIG. 24 is a view showing a WAXD pattern of the fiber formed in Example 2 by drawing (at a drawing temperature of 350° C.) through the first die.
Figure 25:
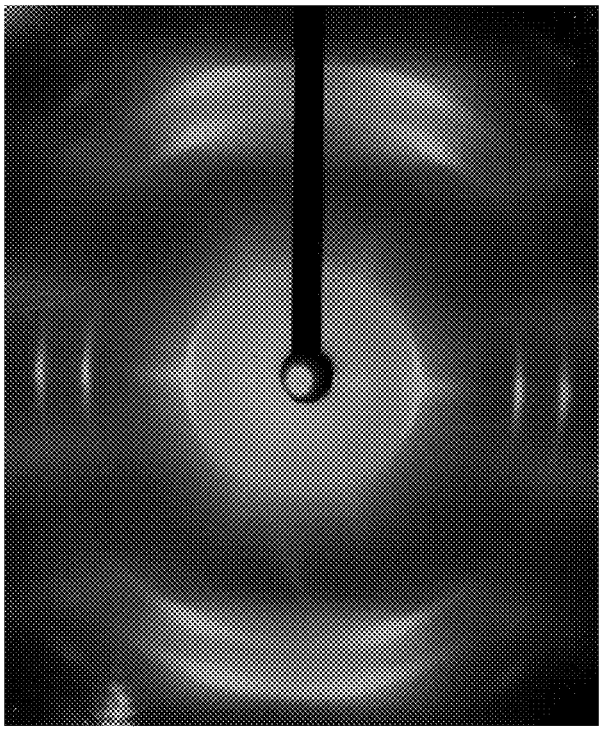
FIG. 25 is a view showing a WAXD pattern of the fiber formed in Example 2 by drawing (at a drawing temperature of 360° C.) through the first die.
Figure 26:
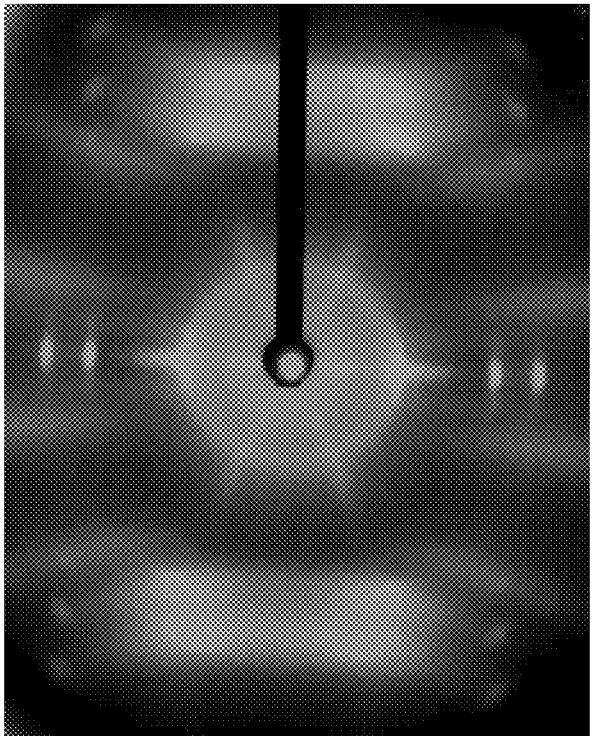
FIG. 26 is a view showing a WAXD pattern of the fiber formed in Example 2 by drawing (at a drawing temperature of 370° C.) through the first die.

FIG. 18 shows the tensile strength and the extension ratio of the first solid material at the time of drawing, against the drawing temperature. FIG. 19 shows the elastic modulus and the extension ratio of the first solid material at the time of drawing, against the drawing temperature. The extension ratio of the first solid material was determined from the diameter (750 μm) of the solid material before being drawn and the fiber diameter of the fiber obtained by the drawing.

As shown in FIGS. 18 and 19, in the drawing at a temperature lower than the melting point of PTFE, the extension ratio, the tensile strength, and the elastic modulus of the obtained fiber hardly varied, but at a drawing temperature of 330° C. or higher, particularly at 340° C. or higher, there was a tendency for the extension ratio, the tensile strength, and the elastic modulus to increase significantly.

Separately, the Toyoflon and the fiber taken from the bag filter, which are PTFE fibers produced by the matrix spinning process and the slit yarn process, respectively, were measured for degree of crystal orientation in the same manner as described above. The result was 0.93 and 0.87, respectively. In addition, these fibers were evaluated for tensile strength, elastic modulus, and breaking elongation.

The results on the Toyoflon were 220 MPa, 2.5 GPa, and 21.5%, respectively. The results on the fiber taken from the bag filter were 1080 MPa, 8.8 GPa, and 24.8%, respectively.

FIGS. 20 to 29 show WAXD patterns of the fibers obtained by drawing at each of the above-mentioned drawing temperatures and the fibers obtained by the above-mentioned conventional methods.

Figure 27:
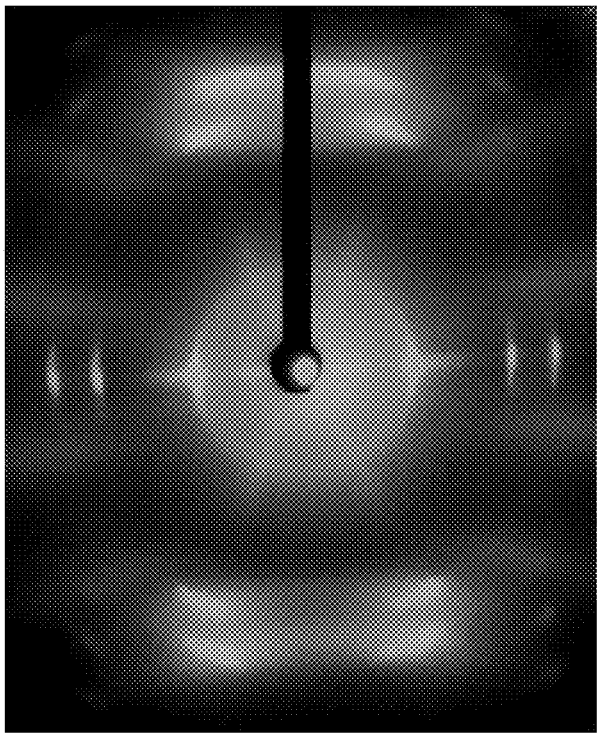
FIG. 27 is a view showing a WAXD pattern of the fiber formed in Example 2 by drawing (at a drawing temperature of 380° C.) through the first die.
Figure 28:
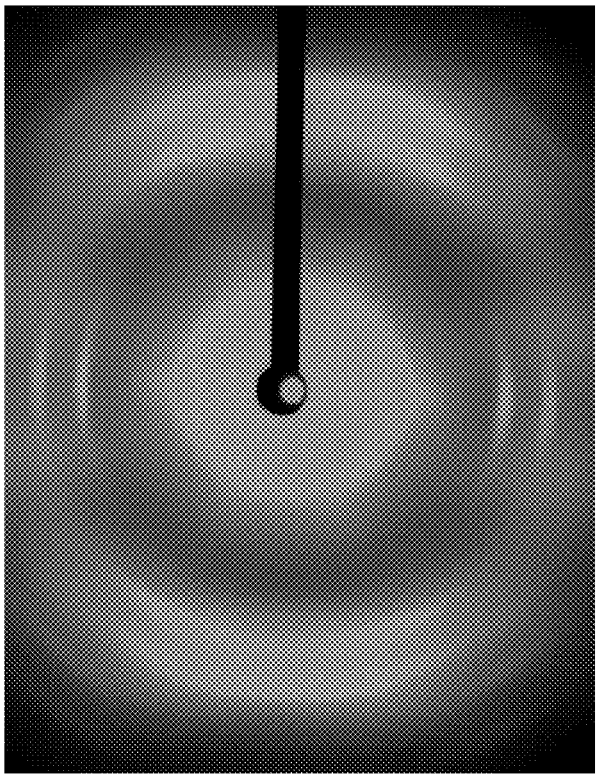
FIG. 28 is a view showing a WAXD pattern of a PTFE fiber produced by the matrix spinning process.
Figure 29:
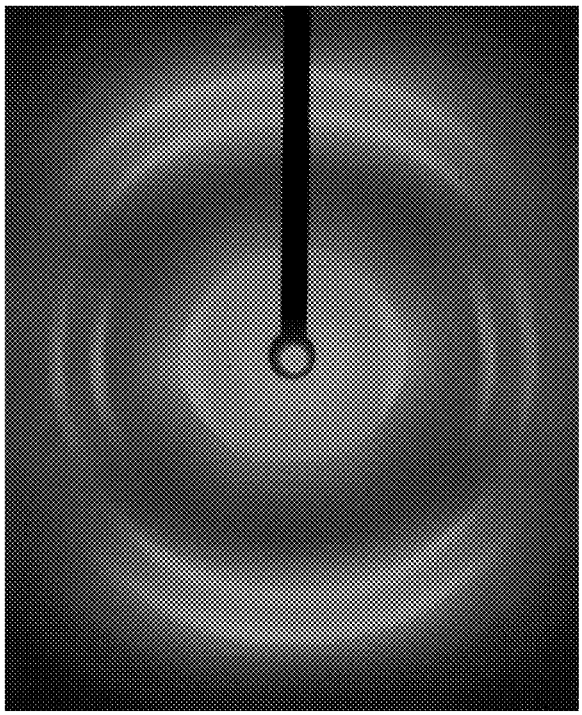
FIG. 29 is a view showing a WAXD pattern of a PTFE fiber produced by the slit yarn process.

As shown in Table 1, the fiber obtained at a drawing temperature of 370° C. and the fiber obtained at a drawing temperature of 380° C. had the same degree of crystal orientation of 0.99. However, as shown in FIGS. 27 and 28, they had a different WAXD pattern from each other. Thus, it is presumed they had a structural difference that was not reflected on the values of their degrees of crystal orientation.

Separately from the above-mentioned evaluation, a small angle X-ray scattering (SAXS) measurement was conducted on each of the fibers to be evaluated. As a result, different profiles (scattering images) were obtained between when the drawing temperature was lower than the melting point and when it was equal to or higher than the melting point. Moreover, the profiles obtained at drawing temperatures equal to or higher than the melting point were different from the profiles obtained from the measurements made on the PTFE fibers produced by the conventional production methods. Although further studies are necessary for detailed analysis, it seems that a larger structure, such as the gap condition of the fiber, can be evaluated in the SAXS measurement than a structure evaluated in the WAXD measurement. Thus, the SAXS measurement possibly can specify more clearly the structure of the fiber of the present invention obtained by drawing at a temperature equal to or higher than the melting point.

Figure 30:
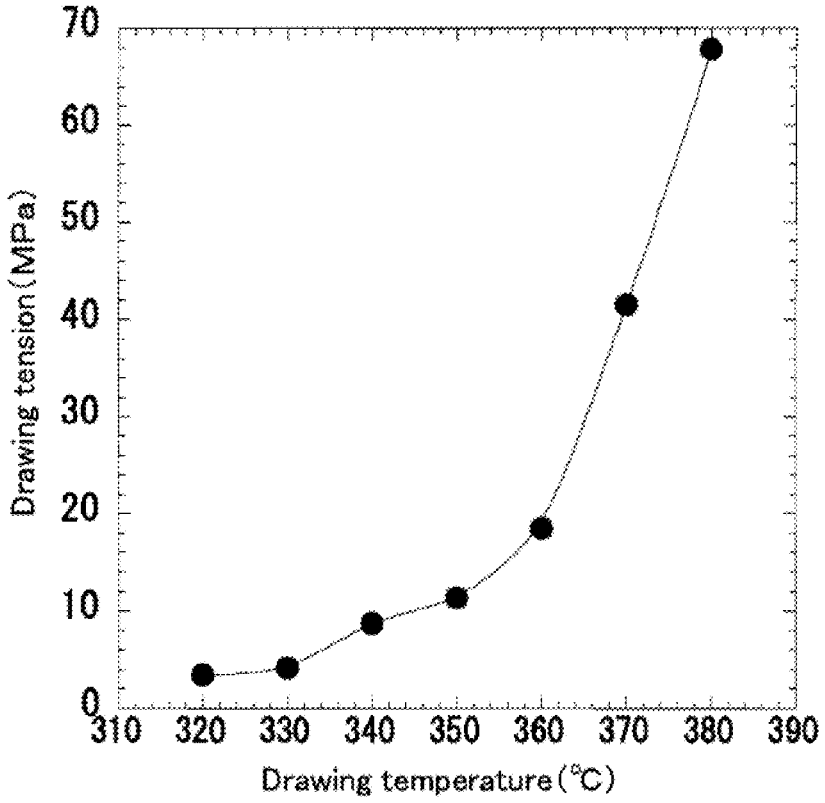
FIG. 30 is a view showing a relationship between the drawing temperature and the drawing tension measured in Example 2.

FIG. 30 shows a variation in a tension (drawing tension) needed to draw the first solid material against a variation in the drawing temperature. Here, the drawing rate was constant.

As shown in FIG. 30, there was a tendency for the drawing tension to increase when the drawing temperature was raised. Although further studies are necessary for detailed analysis, raising the drawing temperature possibly allows the first solid material (and the obtained PTFE fiber) to be extended to a longitudinal direction thereof (the axial direction of the fiber).

Example 3

First, the string-shape second solid material (2 mm in diameter) was formed as in the Example 1. However, the dispersion used was a dispersion obtained by adding a nonionic surfactant (polyoxyethylene alkyl ether: Emulgen 1108 produced by Kao Corp.) to the AD938 produced by Asahi Glass Co., Ltd. so that the concentration of the nonionic surfactant was 1 wt %. The spray pressure at which the dispersion was sprayed into the chamber 21 was 150 MPa.

Subsequently, as in the Example 1, the obtained string-shape solid material was drawn through five of the second die (composed of the same pipette tip as in the Example 1) whose discharge ports have a different diameter from each other, in warm water at 90° C. It should be noted, however, that the discharge ports of the dies had a diameter of 1.6 mm, 1.4 mm, 1.3 mm, 1.1 mm, 1.0 mm, and 0.9 mm, respectively, and the drawing rate was 4.7 m/min.

Subsequently, the solid material drawn in warm water was naturally dried to obtain the string-shape first solid material (700 μm in diameter). The obtained first solid material was drawn through the first die 2 that was made of metal and had the cross-sectional shape shown in FIG. 31, at a drawing temperature of 330° C., 350° C., 380° C., and 400° C., respectively. Thus, the PTFE fibers were obtained. Each of the obtained fibers had a diameter almost uniform throughout the one entire fiber. The cross-sectional shape of the fiber was almost circular, although slight projections and depressions were observed on a surface of the fiber.

Figure 31:
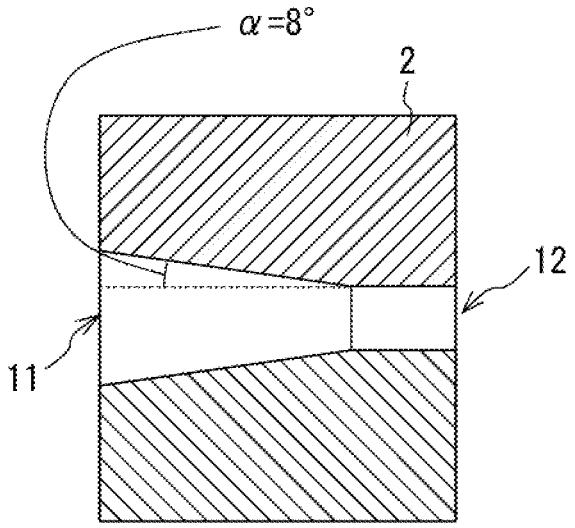
FIG. 31 is a cross-sectional view showing schematically the first die used in Example 3.

A part of a plane in the die 2 shown in FIG. 31 was a conic plane of a cone with a central axis conforming to the extension direction of the solid material and a top being on a side of the direction in which the solid material is drawn, as in the die 2 shown in FIG. 12. In the die 2, the die angle α, which is an angle between a central axis of the cone and a generatrix of the conic plane, was approximately 8°. The fiber discharge port 12 of the die 2 had a diameter of 250 μm.

The drawing of the first solid material through the die 2 was performed while the drawing rate varied from 0.8 m/min. to the highest possible rate for the drawing.

Each of the fibers thus obtained was evaluated for fiber diameter, mechanical properties (tensile strength and tensile modulus), degree of crystal orientation in the axial direction of the fiber, birefringence, thermal property, and dynamic viscoelasticity. Hereinafter, the method for evaluating each of the evaluation items will be described.

[Fiber Diameter and Degree of Crystal Orientation]

The fiber diameter and the degree of crystal orientation were evaluated as in the Example 2.

[Tensile Strength and Tensile Modulus]

The tensile strength and tensile modulus were evaluated as in the Example 1, except for that STA-1150 produced by Orientec Co., Ltd. was used as the tensile testing machine, the tension rate was 100 mm/min., and the distance between chucks was 50 mm.

[Birefringence]

Each of the fibers was evaluated for birefringence Δn using a polarization microscope (OPTIPHOTO2-POL produced by Nikon Corp.) Specifically, the fiber was observed under cross Nicol by using a monochromatic light with a wavelength of λ=589 nm, retardation R thereof was measured by a Berek compensator, and then Δn was calculated by the formula Δn=R/d, where d denotes the fiber diameter.

[Thermal Property and Degree of Crystallization]

Each of the fibers was evaluated for thermal property by using the differential scanning calorimeter (DSC) (DSC3100SA produced by Bruker AX). Alumina was used for a standard sample of the measurement, the rate of temperature increase was 10° C./min., and the flow rate of nitrogen was 50 mL/min.

The degree of crystallization of the fiber was determined from the evaluation result by the DSC, as in the Example 2.

[Dynamic Viscoelasticity]

Each of the fibers was evaluated for dynamic viscoelasticity by using a dynamic viscoelasticity measuring device (MR-300 produced by Rheology Co., Ltd.). The driving frequency was 10 Hz and the rate of temperature increase was 5° C./min. The measurement was made in a temperature range of −150° C. to 400° C.

FIGS. 32 to 39 show the evaluation results.

[Relationships Between Drawing Rate and Fiber Diameter and Between Drawing Rate and Extension Ratio]

Figure 32:
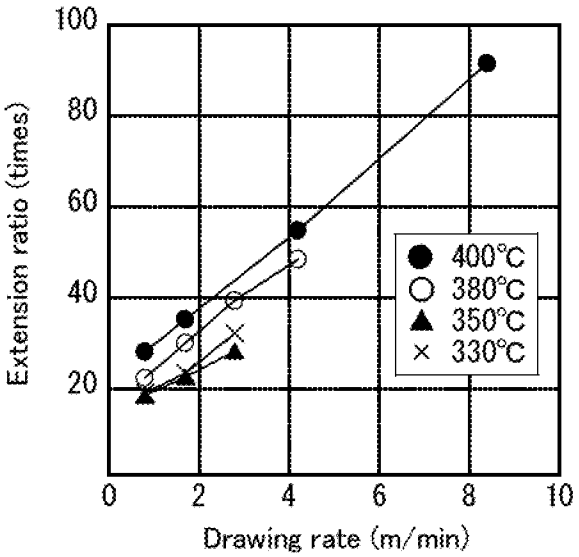
FIG. 32 is a view showing relationships between a diameter of the obtained fiber and a drawing rate and between the extension ratio and the drawing rate when the drawing temperature varies, evaluated in Example 3.
Figure 32:
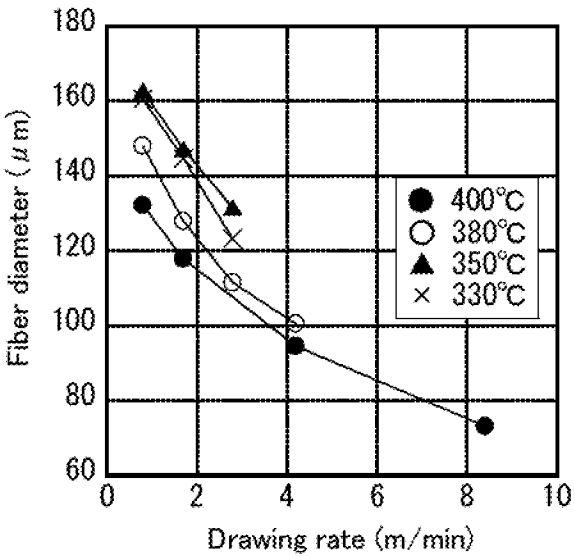

At each of the drawing temperatures equal to or higher than 330° C. used in the Example 3, it was possible to draw the first solid material in a stable manner, that is, it was possible to form the PTFE fiber in a stable manner. As shown in FIG. 32, the drawing rate can be set at a higher rate in accordance with the rise of the drawing temperature. The increased drawing rate reduced the diameter of the obtained fiber and increased the extension ratio at the time of drawing. The extension ratio was obtained from the diameter (700 μm) of the solid material before being drawn and the fiber diameter of the fiber obtained by the drawing, as in the Example 2.

As for the color tone, the obtained fiber was transparent when the drawing temperature was 330° C. and the drawing rate was 0.8 m/min. The rise of the drawing rate changed the color tone of the fiber from translucent to white at this drawing temperature. At other drawing temperatures, the obtained fiber was transparent regardless of the drawing rate.

[Relationships Between Drawing Rate and Elastic Modulus, Between Drawing Rate and Tensile Strength, Between Extension Ratio and Elastic Modulus, and Between Extension Ratio and Tensile Strength]

Figure 33:
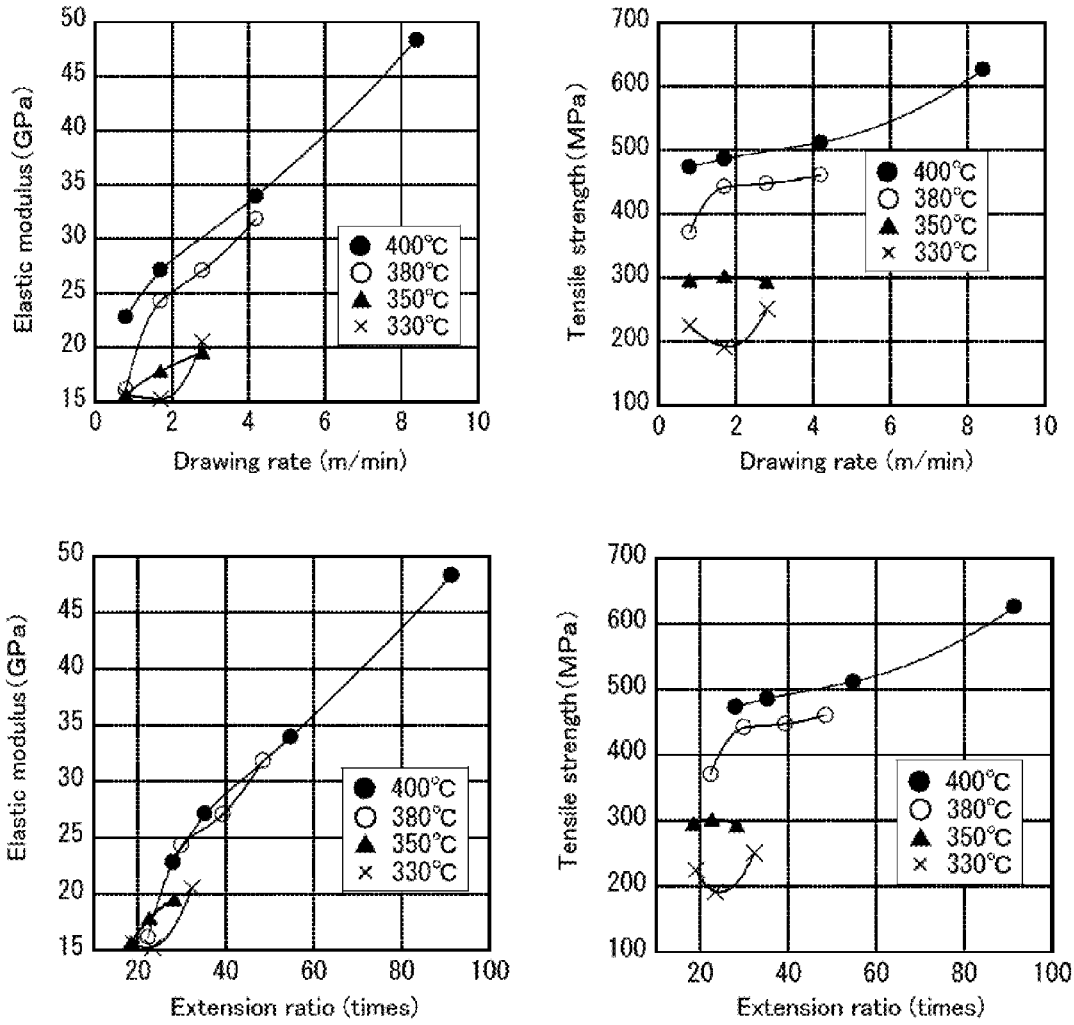
FIG. 33 is a view showing relationships between the elastic modulus of the obtained fiber and the drawing rate, between the tensile strength of the obtained fiber and the drawing rate, between the elastic modulus of the obtained fiber and the extension ratio, and between the tensile strength of the obtained fiber and the extension ratio when the drawing temperature varies, evaluated in Example 3.

As shown in FIG. 33, when the drawing rate increased or when the drawing temperature was raised, the tensile strength and the elastic modulus of the obtained fiber increased. At a drawing temperature of 400° C., the obtained fiber had an elastic modulus of approximately 48 GPa at maximum, and a tensile strength of approximately 620 MPa at maximum.

When the extension ratio increased, the tensile strength and the elastic modulus of the obtained fiber increased. The relationship between the extension ratio and the elastic modulus did not depend on the drawing temperature and remained almost the same at all the drawing temperatures. In contrast, the relationship between the extension ratio and the tensile strength depended on the drawing temperature. When the extension ratio was the same, the tensile strength of the obtained fiber increased as the drawing temperature was raised.

[Relationships Between Drawing Rate and Degree of Crystal Orientation and Between Extension Ratio and Degree of Crystal Orientation]

Figure 34:
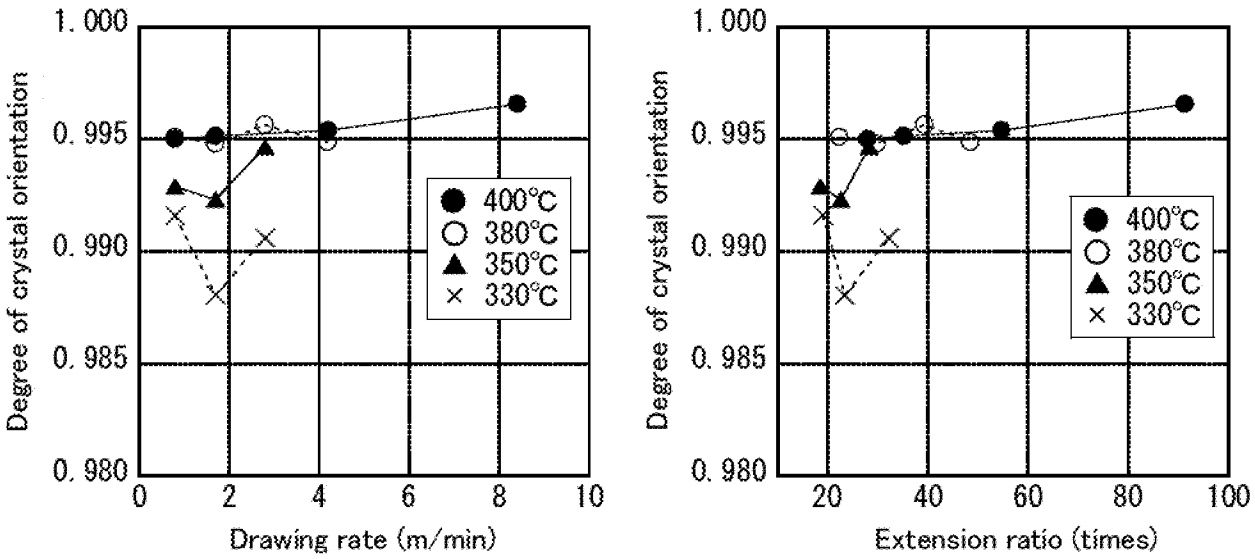
FIG. 34 is a view showing relationships between a degree of crystal orientation of the obtained fiber and the drawing rate and between the degree of crystal orientation of the obtained fiber and the extension ratio when the drawing temperature varies, evaluated in Example 3.

As shown in FIG. 34, there was a tendency for the obtained fiber to have a higher degree of crystal orientation when the drawing temperature increased. The obtained fiber had a degree of crystal orientation of 0.995 or more at a drawing temperature of 380° C. or higher. At a drawing temperature of 380° C. or higher, there was a tendency for the obtained fiber to have a higher degree of crystal orientation when the drawing rate increased. The relationship between the extension ratio and the degree of crystal orientation was almost the same as the relationship between the drawing rate and the degree of crystal orientation.

Figure 40:
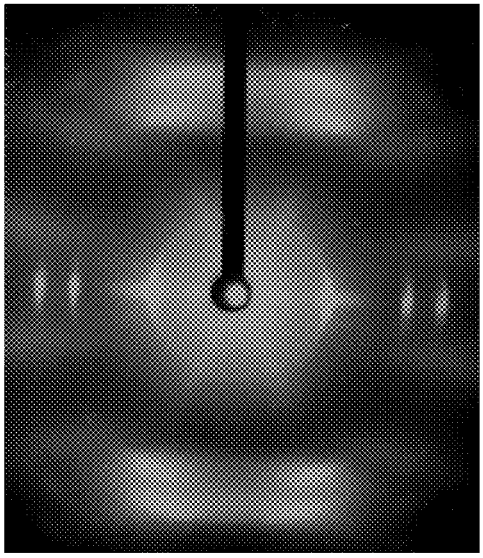
FIG. 40 is a view showing WAXD patterns of the PTFE fibers formed in Example 3 by drawing through the first die.
Figure 40:
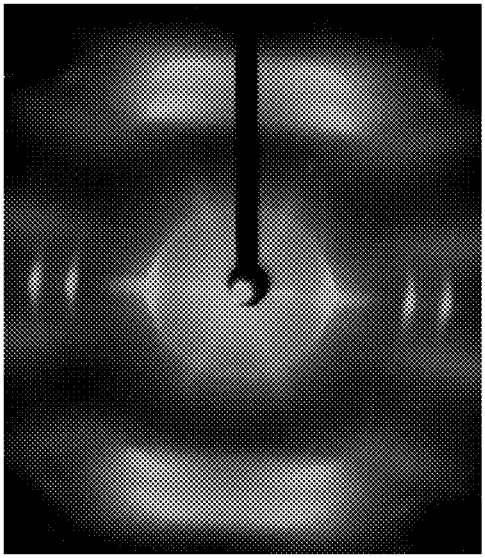
Figure 40:
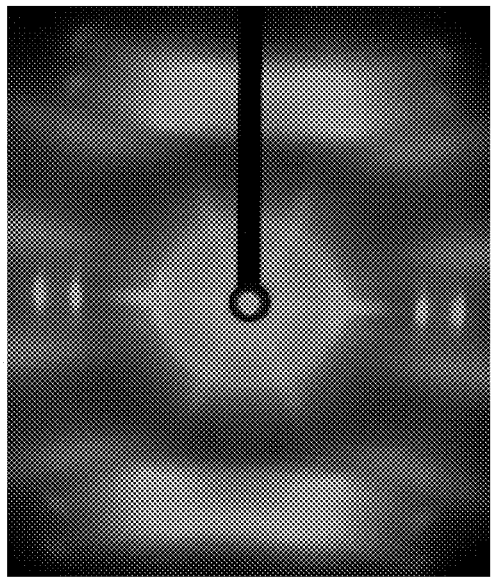
Figure 40:
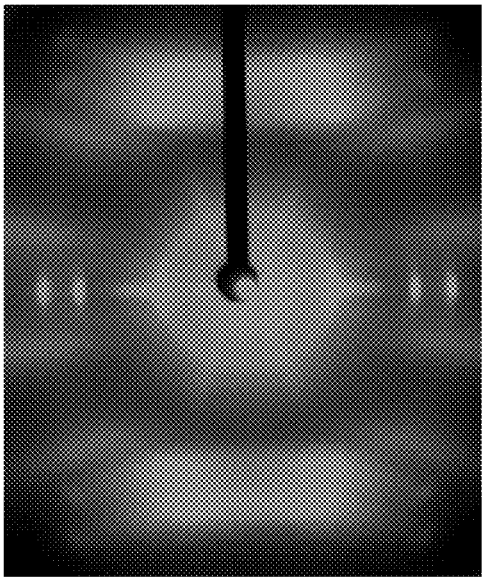
Figure 41:
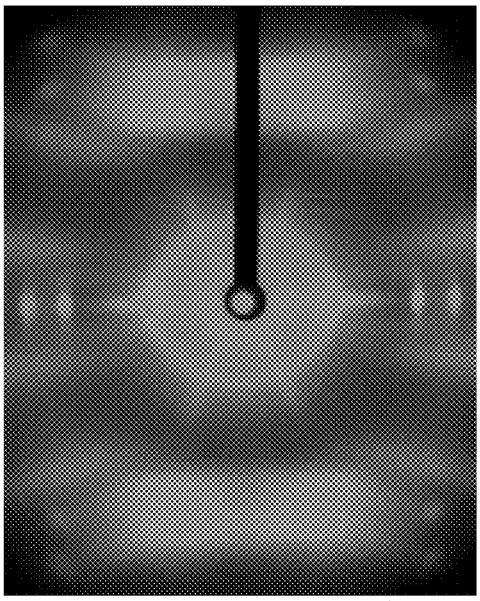
FIG. 41 is a view showing WAXD patterns of the PTFE fibers formed in Example 3 by drawing through the first die.
Figure 41:
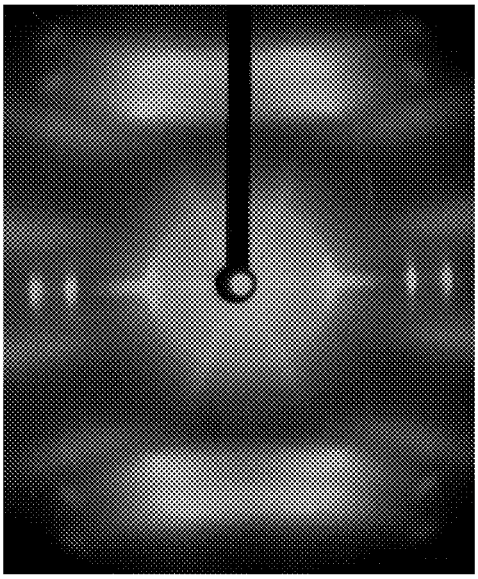
Figure 41:
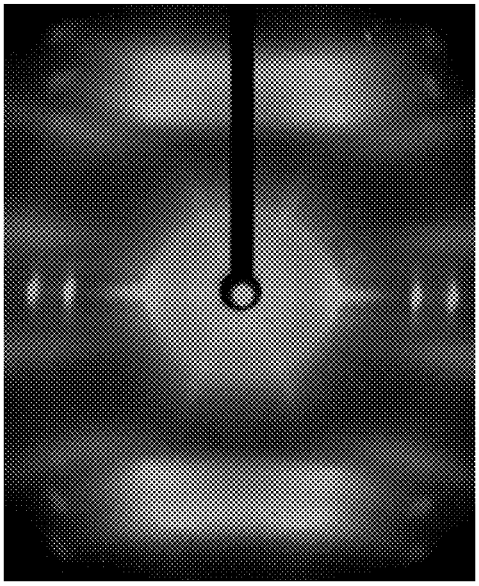
Figure 41:
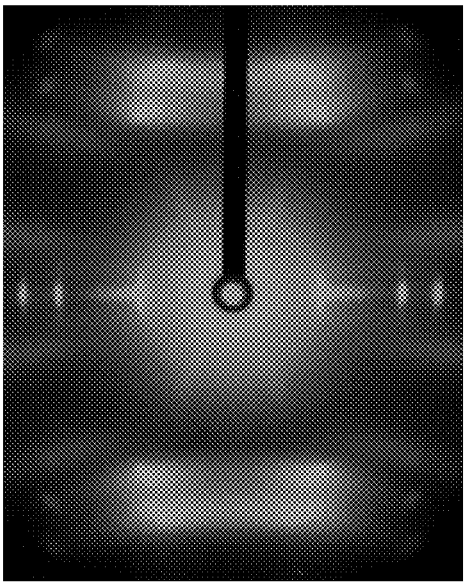

FIGS. 40 and 41 show respectively WAXD patterns of the fibers formed as mentioned above.

[Relationships Between Drawing Rate and Birefringence Δn and Between Extension Ratio and Birefringence Δn]

The birefringence Δn can be defined also as a value obtained by equalizing optical anisotropies of a crystalline phase and an amorphous phase in the PTFE fiber according to the volume fraction of each of the phases. Thus, it seems that the Δn makes it possible to observe the state of orientation in the amorphous phase, although there is a problem in that the birefringence Δn is affected by a structural birefringence.

Figure 35:
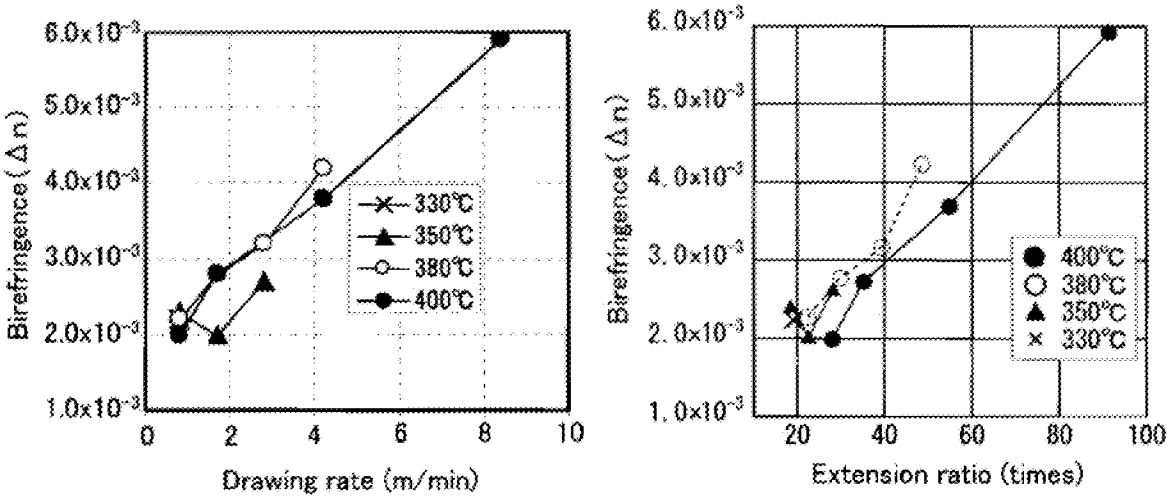
FIG. 35 is a view showing relationships between a birefringence of the obtained fiber and the drawing rate and between the birefringence of the obtained fiber and the extension ratio when the drawing temperature varies, evaluated in Example 3.

As shown in FIG. 35, there was a tendency for the obtained fiber to have a larger birefringence when the drawing temperature was increased. When taking this into consideration together with the results of the degree of crystal orientation shown in FIG. 34, it seems that a higher drawing temperature raised not only the degree of orientation in the crystalline phase but also that in the amorphous phase. The relationship between the drawing rate and the birefringence was almost the same as the relationship between the extension ratio and the birefringence.

[Thermal Property]

Figure 36:
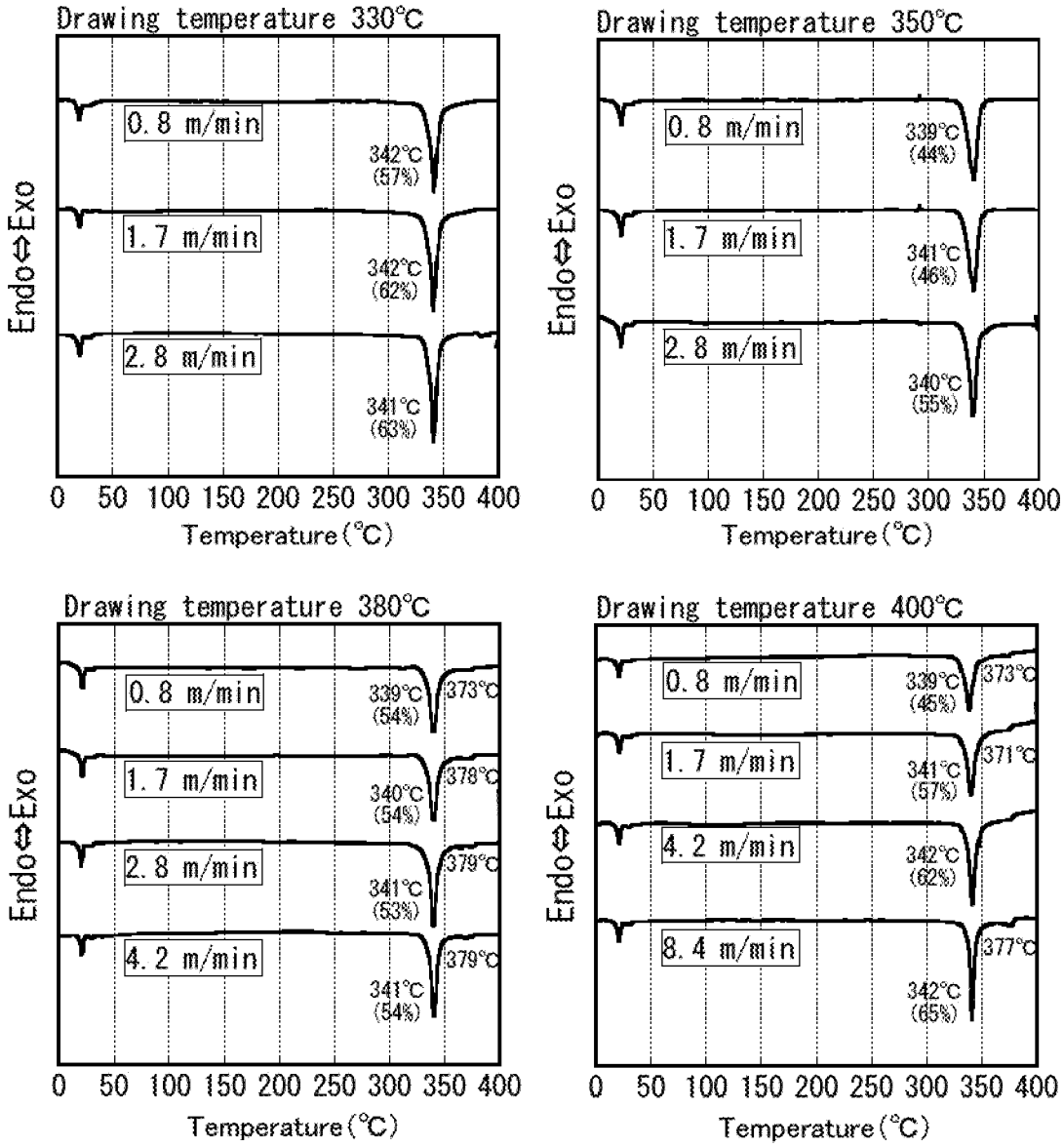
FIG. 36 is a view showing a DSC curve of the obtained fiber when the drawing temperature and the drawing rate vary, evaluated in Example 3.

As shown in FIG. 36, it was found that the drawing lowers a melting peak temperature (a temperature of an endothermic peak at around 350° C. on a DSC curve, which was 345° C. before the drawing.) When the drawing temperature was 380° C. or higher, another new endothermic peak (a high temperature side peak) was observed in the temperature range of 370° C. to 380° C. on the DSC curve. The generation of the high temperature side peak suggests that when the drawing temperature was increased, two kinds of crystals morphologically different from each other were formed and the obtained fiber was in a metastable crystalline state.

Figure 37:
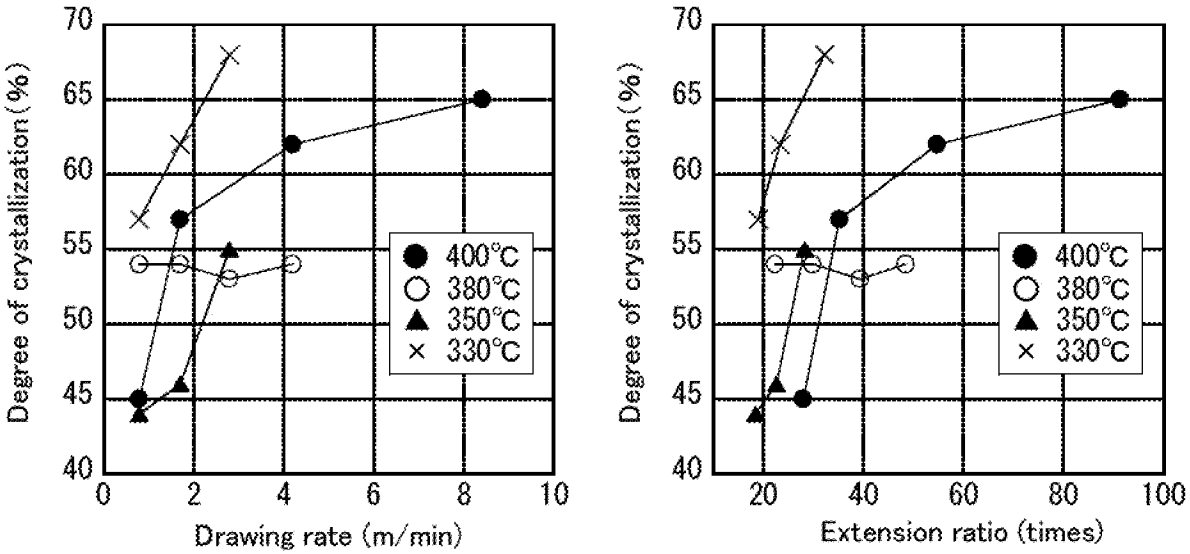
FIG. 37 is a view showing relationships between a degree of crystallization of the obtained fiber and the drawing rate and between the degree of crystallization of the obtained fiber and the extension ratio when the drawing temperature varies, evaluated in Example 3.

This also is suggested by the variation in the degree of crystallization against the drawing rate and that against the extension ratio shown in FIG. 37, specifically, by the tendency for the degree of crystallization to be higher as the drawing rate and the extension ratio increase.

In FIG. 36, the values shown with an unit "m/min" denote the "drawing rates (m/min.)", and the parenthesized values written together with the endothermic peak temperature denote the degree of crystallization (%) of the obtained fiber.

[Dynamic Viscoelasticity]

A dynamic viscoelasticity measurement can predict the aggregation state of molecules in the obtained fiber, based on a mechanical relaxation phenomenon accompanying a rise in temperature. It is known that there are α peak, β peak, and γ peak in PTFE with respect to a value of logarithmic decrement of PTFE. In the profile of a storage modulus, steps corresponding these peaks are referred to as α dispersion, β dispersion, and γ dispersion, respectively. The α dispersion and the γ dispersion seem to be derived from the movement in an amorphous part of a polymer, and tend to decrease when the degree of crystallization of the polymer increases. The β dispersion seems to be derived from the molecular movement in a crystal part of a polymer, and tends to increase when the degree of crystallization of the polymer increases.

Figure 38:
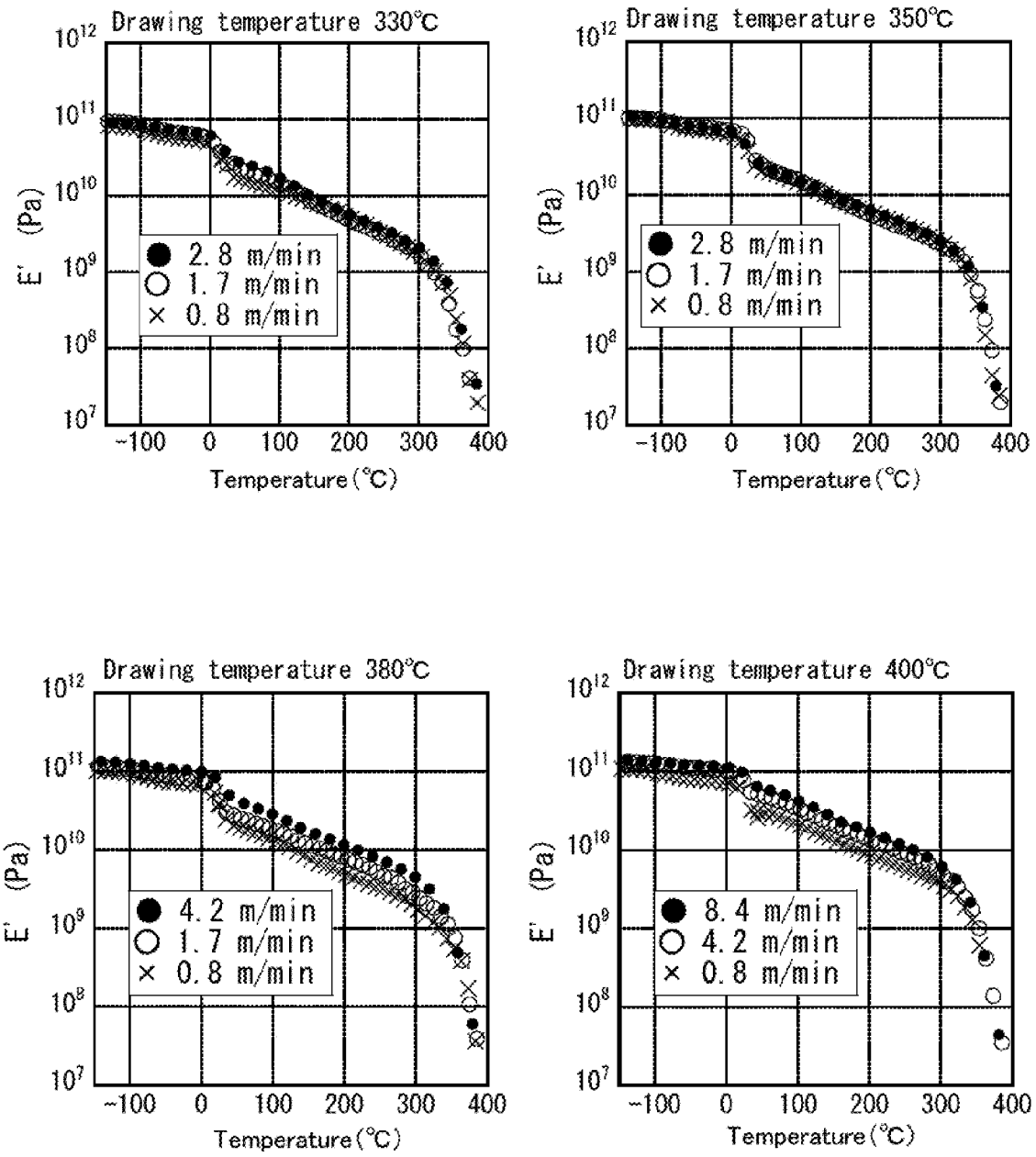
FIG. 38 is a view showing profiles of storage modulus (E') of the obtained fiber when the drawing temperature and the drawing rate vary, evaluated in Example 3.
Figure 39:
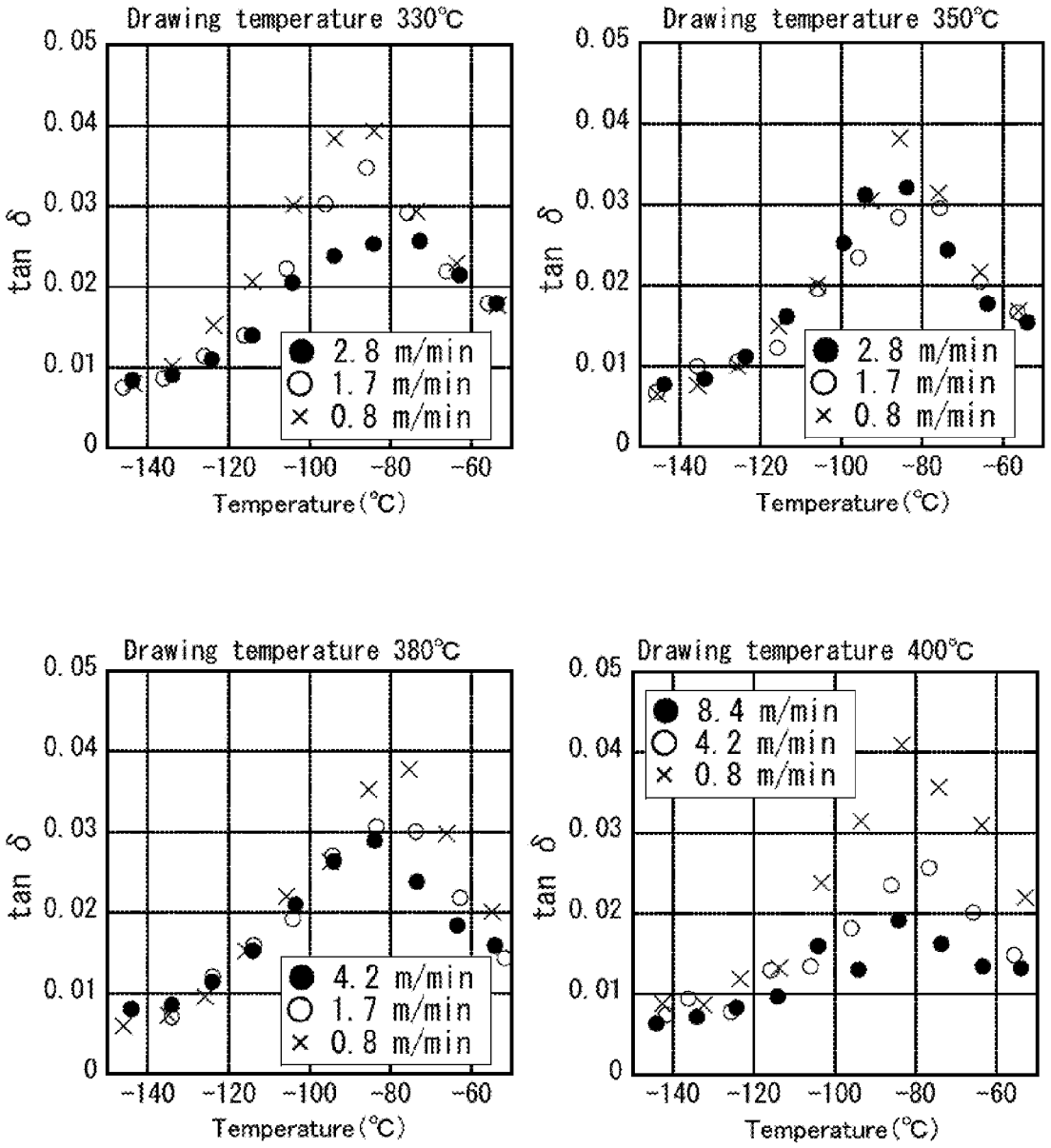
FIG. 39 is a view showing loss tangents (tan δ) in a region corresponding to a gamma dispersion in the storage modulus profiles shown in FIG. 38.

FIG. 38 shows storage moduli (E') of the fibers obtained by drawing at the different drawing temperatures and rates. FIG. 39 shows loss tangents (tan δ) in regions corresponding to the γ dispersions in the storage modulus profiles shown in FIG. 38.

As shown in FIGS. 38 and 39, the value of the storage modulus (E') of the obtained fiber increased when the drawing temperature was raised, and showed the same tendency as that of the elastic modulus described above. The γ dispersion decreased when the drawing rate was increased, and showed the same tendency as that of the variation in the degree of crystallization defined by the evaluation of the thermal property.

Figure 42:
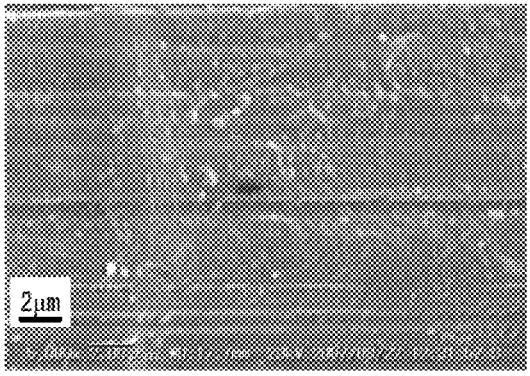
FIG. 42 is a view showing SEM images of surfaces of the PTFE fibers formed in Example 3 by drawing through the first die.
Figure 42:
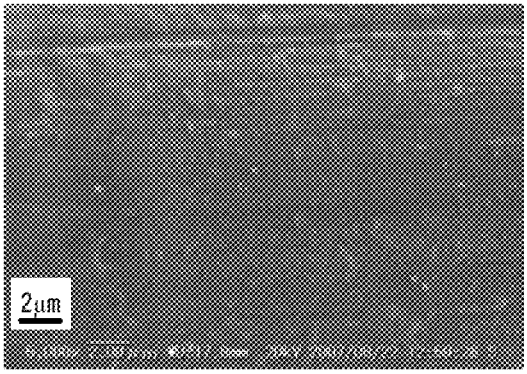
Figure 42:
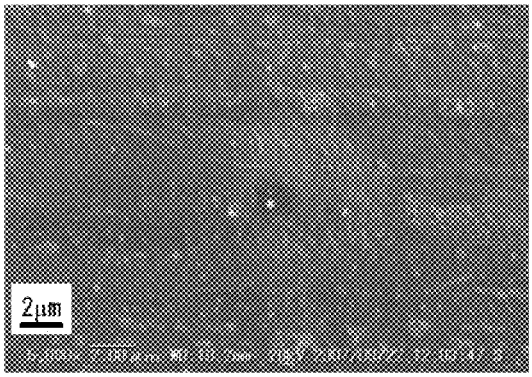
Figure 42:
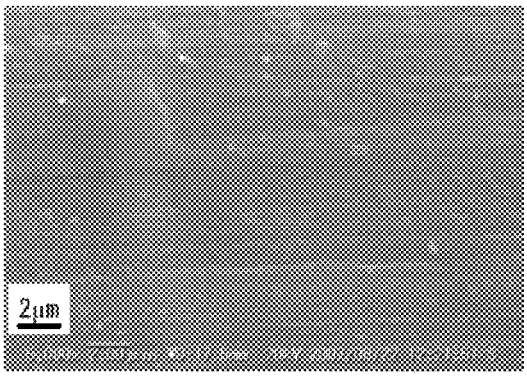
Figure 43:
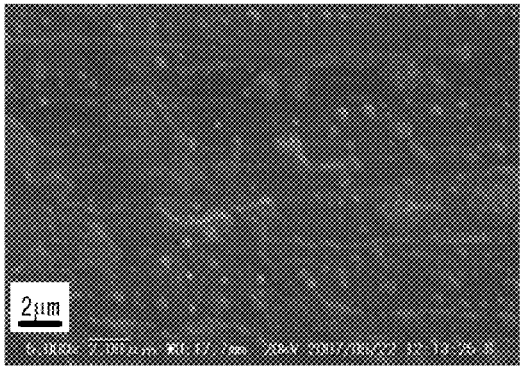
FIG. 43 is a view showing SEM images of surfaces of the PTFE fibers formed in Example 3 by drawing through the first die.
Figure 43:
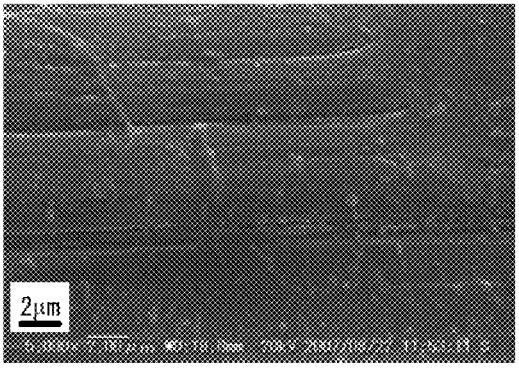
Figure 43:
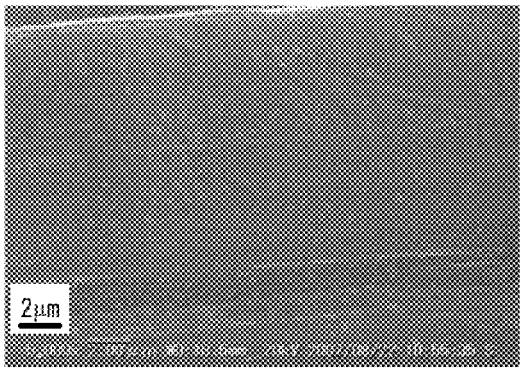
Figure 43:
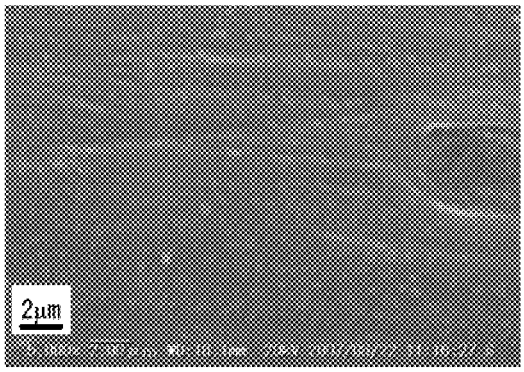
Figure 44:
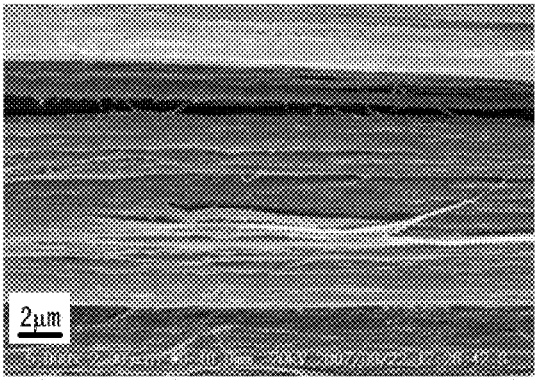
FIG. 44 is a view showing SEM images of cross sections of the PTFE fibers formed in Example 3 by drawing through the first die.
Figure 44:
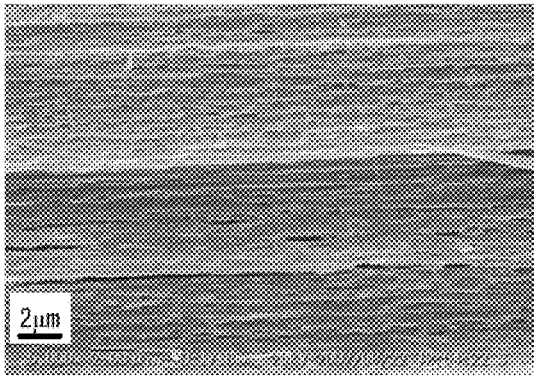
Figure 44:
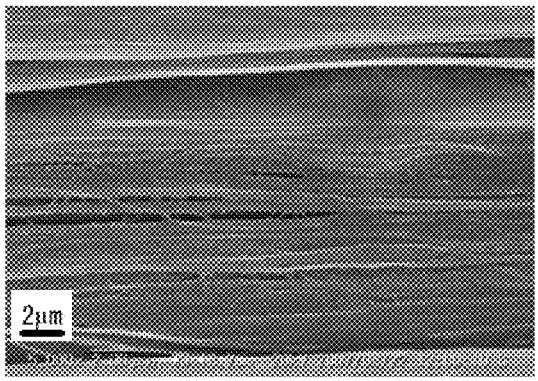
Figure 44:
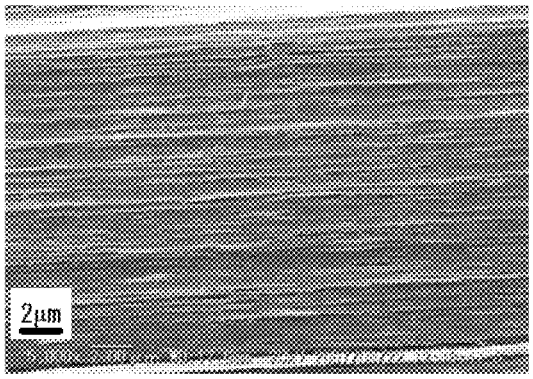
Figure 45:
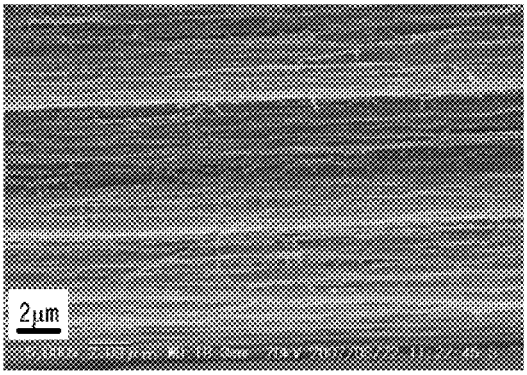
FIG. 45 is a view showing SEM images of cross sections of the PTFE fibers formed in Example 3 by drawing through the first die.
Figure 45:
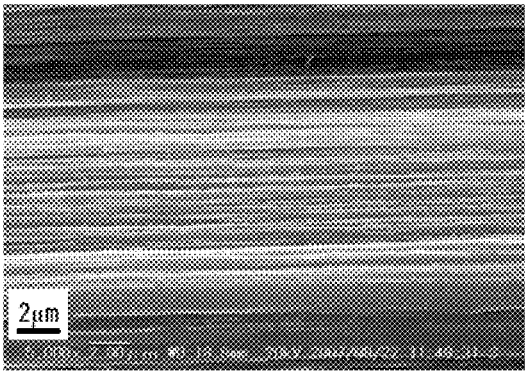
Figure 45:
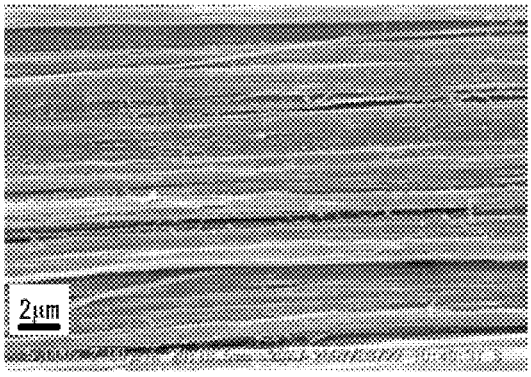
Figure 45:
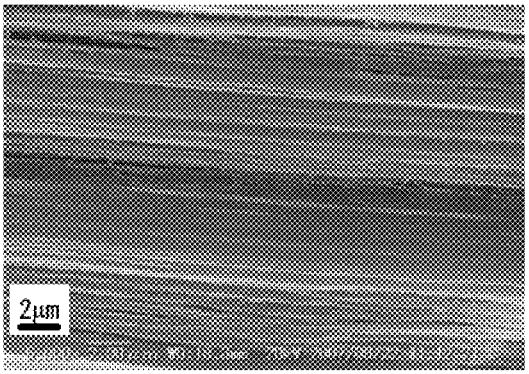

FIGS. 42 and 43 show examples of surfaces of the fibers obtained in the Example 3, evaluated by SEM. FIGS. 44 and 45 show examples of cross sections of the fibers obtained in the Example 3, evaluated by SEM.

As shown in FIGS. 42 and 43, it was possible to form the PTFE fibers with an almost smooth surface, although minute projections and depressions extended in the axial direction of the fiber were observed. As shown in FIGS. 44 and 45, it was possible to form the PTFE fibers having a plurality of the PTFE fused portions extended in the axial direction of the fiber.

The present invention can be applied to other embodiments that do not depart from its intention and essential features. The embodiments disclosed in this specification are explanatory in all senses and do not limit the present invention. The scope of the present invention is represented not by the above explanation but by accompanying claims, and encompasses all modifications which have a meaning and scope equivalent to the claims.

INDUSTRIAL APPLICABILITY

The present invention makes it possible to obtain the PTFE fiber without using a matrix material, unlike the emulsion spinning process. Also, the present invention makes it possible to produce the PTFE fiber with higher productivity than those of conventional production methods such as the slit yarn process.

The invention claimed is:

1. A method for producing a polytetrafluoroethylene fiber, comprising:

reducing a diameter of a string-shape polytetrafluoroethylene (PTFE)-containing solid material (a first solid material) by drawing the first solid material at a temperature equal to or higher than a melting point of PTFE, wherein the first solid material is drawn through a first die, wherein the first solid material is a solid material obtained by drawing a strip-shape PTFE-containing solid material (a second solid material) containing water and a surfactant through a second die so as to reduce a diameter of the second solid material, and then reducing an amount of the water contained in the second solid material, and wherein the second solid material is drawn through the second die in water.

2. The method for producing the polytetrafluoroethylene fiber according to claim 1, wherein the first solid material is drawn at 330° C. or higher.

3. The method for producing the polytetrafluoroethylene fiber according to claim 1, wherein the first die includes a portion as a space through which the first solid material passes, a cross section of the portion decreases in area continuously from one opening toward another opening of the first die, and the cross section is perpendicular to a direction in which the first solid material is drawn.

4. The method for producing the polytetrafluoroethylene fiber according to claim 1, wherein the second solid material is a solid material obtained by applying a force to a dispersion of PTFE particles containing the PTFE particles, a surfactant, and water serving as a dispersion medium, the force making the particles approach or contact with each other.

5. The method for producing the polytetrafluoroethylene fiber according to claim 1, wherein:

the surfactant is a nonionic surfactant; and the second solid material is a solid material obtained by applying a mechanical force to a dispersion of PTFE particles containing the PTFE particles, the nonionic surfactant, and water serving as a dispersion medium so as to allow the particles to collide with each other, and raising a temperature of the dispersion by a heat generated by the collision as well as allowing the particles to be bound to each other in a temperature range equal to or higher than (T−30)° C. in terms of the temperature of the dispersion, where T (° C.) denotes a clouding point of the nonionic surfactant.

6. The method for producing the polytetrafluoroethylene fiber according to claim 1, wherein:

the first solid material contains PTFE particles in a central portion thereof; and the drawing at a temperature equal to or higher than the melting point allows the particles to be fused to each other and reduces the diameter of the first solid material so as to obtain a fiber containing a fused portion of the particles extended in an axial direction of the fiber.

7. The method for producing the polytetrafluoroethylene fiber according to claim 1, which comprises reducing the diameter of the string-shape first solid material by applying a compression force to the string-shape first solid material in a radial direction.

8. The method for producing the polytetrafluoroethylene fiber according to claim 1, which comprises: drawing the string-shape first solid material through an opening that has a diameter smaller than the diameter of the string-shape first solid material.

* * * * *